US006327448B1

(12) United States Patent
Sasaki

(10) Patent No.: US 6,327,448 B1
(45) Date of Patent: Dec. 4, 2001

(54) CONNECTING MEMBER, PROCESS CARTRIDGE AND ELECTROPHOTOGRAPHIC IMAGE FORMING APPARATUS

(75) Inventor: Teruhiko Sasaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/625,853

(22) Filed: Jul. 26, 2000

(30) Foreign Application Priority Data

Jul. 28, 1999 (JP) ..... 11-213368

(51) Int. Cl.[7] ..... G03G 21/18
(52) U.S. Cl. ..... 399/111; 399/113
(58) Field of Search ..... 399/110, 111, 399/113

(56) References Cited

U.S. PATENT DOCUMENTS 5,581,328 * 12/1996 Yashiro ..... 399/111
5,890,036 * 3/1999 Karakama et al. ..... 399/111 X
5,920,753 7/1999 Sasaki et al. ..... 399/111
6,173,140 * 1/2001 Suzuki et al. ..... 399/113
6,208,818 * 3/2001 Noda ..... 399/111

* cited by examiner

*Primary Examiner*—William J. Royer
(74) *Attorney, Agent, or Firm*—Fitzpatrick, Cella, Harper & Scinto

(57) ABSTRACT

A first frame for holding an electrophotographic photosensitive member and a second frame for holding a developing device for developing an electrostatic latent image formed on the electrophotographic photosensitive member with a developer are arranged in a process cartridge detachably mountable to a main body of an electrophotographic image forming apparatus and are rotatably connected to each other by a connecting member. The connecting member has a connecting portion which is fitted into an external hole formed in an external side of the first frame, an internal hole formed in an internal side of the first frame, and a hole formed in the second frame and located between the external hole and the internal hole of the first frame, and rotatably connects the first and second frames to each other.

26 Claims, 16 Drawing Sheets

CONNECTING MEMBER, PROCESS CARTRIDGE AND ELECTROPHOTOGRAPHIC IMAGE FORMING APPARATUS

BACKGROUND OF THE INVENTION

1. Field of the Invention

The present invention relates to a connecting member, a process cartridge and an electrophotographic image forming apparatus.

Here, the term "electrophotographic image forming apparatus" relates to an apparatus that forms an image on a recording medium by using an electrophotographic image forming system. For example, an electrophotographic image forming apparatus includes an electrophotographic copying machine, an electrophotographic printer (e.g., a laser beam printer, a LED printer, etc.), a facsimile telegraph, a word processor, etc.

The process cartridge integrally combines charging means, developing means or cleaning means, and an electrophotographic photosensitive member into a cartridge that is detachably mountable to a main body of an electrophotographic image forming apparatus. The process cartridge also integrally combines the electrophotographic photosensitive member and at least one of the charging means, the developing means and the cleaning means into a cartridge that is detachably mountable to the main body of the electrophotographic image forming apparatus. Further, the process cartridge integrally combines at least the developing means and the electrophotographic photosensitive member into a cartridge which is detachably mountable to the main body of the electrophotographic image forming apparatus.

2. Related Background Art

The electrophotographic image forming apparatus using an electrophotographic image forming process conventionally adopts a process cartridge system in which the electrophotographic photosensitive member and process means acting on this electrophotographic photosensitive member are integrally made into a cartridge which is detachably mountable to the main body of the electrophotographic image forming apparatus. In accordance with this process cartridge system, the electrophotographic image forming apparatus can be personally maintained by a user instead of a service man so that operability can be greatly improved. Therefore, this process cartridge system is widely used in the image forming apparatus.

Such a process cartridge has a cleaning container (first frame) for holding a photosensitive drum as the electrophotographic photosensitive member, and a developing container (second frame) for holding the developing means for developing an electrostatic latent image formed on the photosensitive drum by toner (developer). The above cleaning container and the above developing container are rotatably connected to each other by a connecting member having a round bar shape.

In recent years, a used process cartridge is collected, disassembled and cleaned and is then reutilized (recycled). In a disassembly process of the used process cartridge, the connecting member connecting the developing container and the cleaning container is first detached. In this case, the connecting member is pulled out of an outside side surface of the cleaning container. However, it is necessary to pull out the connecting member without damaging the cleaning container so as to reutilize the cleaning container.

The disassembly process will next be explained with reference to FIGS. 14, 15A, 15B and 16.

When the process cartridge 100 is disassembled into the developing container 102 and the cleaning container 103 to reutilize (recycle) this process cartridge, it is necessary to first detach connecting pins 108*a*, 108*b* (no connecting pin 108*a* is illustrated) connecting the developing container 102 and the cleaning container 103. However, as shown in FIG. 14, the connecting pins 108*a*, 108*b* are connected to connecting holes 106*a*, 106*b*, 107*a*, 107*b*, 107*c*, 107*d* (no connecting holes 106*a*, 107*a*, 107*c* are illustrated) such that no end face 108*d* of a connecting portion 108*c* is projected from outer walls 103*a*, 103*b* (no outer wall 103*a* is illustrated) of the cleaning container 103. Therefore, it is difficult to detach the connecting pins 108*a*, 108*b* without damaging the cleaning container 103.

Therefore, it has been considered to connect the developing container 102 and the cleaning container 103 in the process cartridge 100 by using a connecting pin 200 as shown in FIG. 15A so as to improve the disassembly property of the process cartridge. FIG. 15A is a front view of the connecting pin 200 in which the disassembly property of the process cartridge is improved. FIG. 15B is a cross-sectional view of the connecting portion of the developing container 102 and the cleaning container 103 using the connecting pin 200 shown in FIG. 15A.

The connecting pin 200 has a connecting portion 200*a*, a head portion 200*b* and a grip portion 200*c*. The connecting portion 200*a* is fitted into each of connecting holes 106*b*, 107*b*, 107*d* (106*a*, 107*a*, 107*c*) of the developing container 102 and the cleaning container 103, and rotatably connects the cleaning container 103 and the developing container 102 to each other. The head portion 200*b* has a diameter larger than that of the connecting portion 200*a* and comes in contact with the outer wall 103*b* (103*a*) of the cleaning container 103. The grip portion 200*c* has a diameter larger than that of the head portion 200*b* and is formed to easily detach the connecting pin 200. When the process cartridge 100 is disassembled, the grip portion 200*c* of the connecting pin 200 is gripped by a tool such as pliers, etc., and the connecting pin 200 is pulled out of the cleaning container 103. Thus, the process cartridge 100 can be easily disassembled into the developing container 102 and the cleaning container 103.

However, it has become desirable to narrow the clearance between a longitudinal outside face of the process cartridge and an inside face of the image forming apparatus main body at a mounting time of the process cartridge onto the image forming apparatus main body, i.e., the clearance t (see FIG. 16) between a frame 150 of the image forming apparatus main body A1 and the outer wall 103*b* of the cleaning container 103 as much as possible so as to make compact the image forming apparatus main body A1 and the process cartridge 100. Therefore, it is necessary to arrange a connecting pin for easily disassembling the process cartridge 100 without projecting an end face (the head portion 200*b* and the grip portion 200*c*) from the outer wall 103*b* of the cleaning container 103 as in the above connecting pin 200.

The present invention is obtained by further developing the above discussed conventional art.

SUMMARY OF THE INVENTION

An object of the present invention is to provide a connecting member able to be simply pulled out, a process cartridge using the connecting member, and an electrophotographic image forming apparatus to which the process cartridge can be detachably attached.

Another object of the present invention is to provide a connecting member not projected from an external surface of a frame in connection of the frames, a process cartridge using the connecting member, and an electrophotographic image forming apparatus to which the process cartridge can be detachably attached.

Still another object of the present invention is to provide a connecting member able to make compact a process cartridge and an electrophotographic image forming apparatus capable of detachably attaching the process cartridge thereto, the process cartridge using the connecting member, and the electrophotographic image forming apparatus to which the process cartridge can be detachably attached.

Yet another object of the present invention is to provide a reusable connecting member, a process cartridge using the connecting member, and an electrophotographic image forming apparatus to which the process cartridge can be detachably attached.

Yet still another object of the present invention is to provide a connecting member having a connecting portion inserted into a hole formed in a first frame and a hole formed in a second frame to connect the first and second frames, and a head portion arranged on an upstream side from the connecting portion in an insertion direction in which the connecting portion is inserted into the hole formed in the first frame and the hole formed in the second frame, wherein the head portion has a size smaller than that of the connecting portion in a direction crossing the insertion direction.

Further another object of the present invention is also to provide a process cartridge using this connecting member, and an electrophotographic image forming apparatus to which this process cartridge can be detachably attached.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Embodiments of the present invention will next be described on the basis of the accompanying drawings.

In the following explanation, the longitudinal direction of a process cartridge is a direction (an approximately perpendicular direction) crossing a direction in which the process cartridge is detachably attached to a main body of an image forming apparatus. This longitudinal direction is a direction parallel to the surface of a recording medium and crossing (approximately perpendicular to) a conveying direction of the recording medium. Further, left-hand and right-hand sides with respect to the process cartridge are a right-hand or left-hand side on which the recording medium is seen from above in accordance with the conveying direction of the recording medium.

[First Embodiment]

Figure 12:
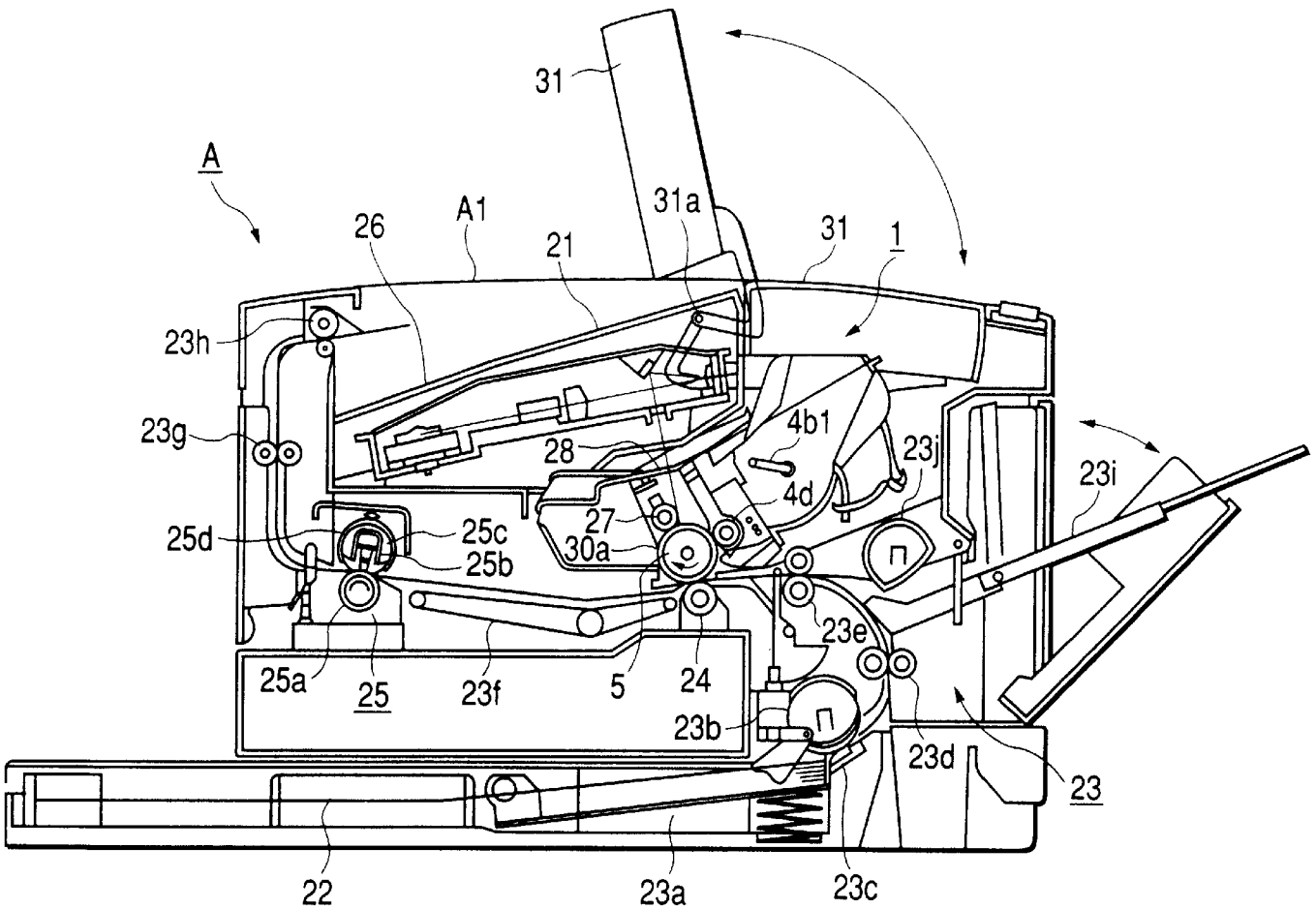
FIG. 12 is a cross-sectional view showing the schematic construction of an electrophotographic image forming apparatus.

FIG. 12 shows schematic constructions of the process cartridge 1 and an electrophotographic image forming apparatus (laser beam printer) A able to mount this process cartridge thereto in this embodiment.

Here, the entire constructions of the process cartridge and the electrophotographic image forming apparatus using this process cartridge will be first explained with reference to FIGS. 12 and 13. The connecting construction of a cleaning container and a developing container using a connecting member of the process cartridge will next be explained with reference to FIGS. 1 to 5 and 10 to 11.

In the electrophotographic image forming apparatus (laser beam printer) A according to this embodiment, as shown in FIG. 12, information light based on image information is projected from an optical system 21 to an electrophotographic photosensitive member (hereinafter referred to as a "photosensitive drum") 5 of a drum shape so that an electrostatic latent image is formed on the photosensitive drum 5. This latent image is developed by using toner (developer) so that a toner image is formed. A recording medium 22 such as recording paper, or an OHP sheet is separated and fed one by one from a cassette 23*a* in synchronism with the formation of the toner image by a pickup roller 23*b* and a press contact member 23*c* coming in press contact with this pickup roller 23*b*. The recording medium 22 is also conveyed by conveying means 23 constructed by a conveying roller pair 23*d*, and a registration roller pair 23*e*. The toner image formed on the photosensitive drum 5 is transferred to the recording medium 22 by applying a voltage to a transfer roller 24 as transfer means. The recording medium 22 is then conveyed to fixing means 25 by a conveying belt 23*f*. The fixing means 25 is constructed by a drive roller 25*a* and a fixing rotary member 25*d*. A heater 25*b* is built in the fixing rotary member 25*d* and the fixing rotary member 25*d* is constructed by a sleeve-shaped sheet rotatably supported by a supporting member 25*c*. The fixing means 25 fixes the transferred toner image to the recording medium 22 by applying heat and pressure to the passing recording medium 22. The recording medium 22 is then conveyed by discharge roller pairs 23*g*, 23*h* and is discharged to a discharge portion 26 through a surface reverse path. In the image forming apparatus A, the recording medium 22 can be manually fed by a manual feed tray 23*i* and a roller 23*j*.

In contrast to this, the process cartridge 1 has the electrophotographic photosensitive member and at least one process means. Here, for example, the process means includes charging means for charging the electrophotographic photosensitive member, developing means for developing the latent image formed on the electrophotographic photosensitive member, and cleaning means for cleaning toner remaining on the surface of the electrophotographic photosensitive member.

In the process cartridge 1 according to this embodiment, the photosensitive drum 5 as the electrophotographic photosensitive member having a photoconductive layer is rotated as shown in FIG. 12. A voltage is then applied to a charging roller 27 as the charging means so that the surface of the above photosensitive drum 5 is uniformly charged. An optical image from the optical system 21 is exposed to the charged photosensitive drum 5 through an opening portion 28 so that an electrostatic latent image is formed. The electrostatic latent image is then developed by toner (developer) in the developing means 4.

The developing means 4 sends out the toner within a toner containing portion 4*a* by a rotatable first feeding member 4*b*1 and a rotatable second feeding member 4*b*2 as feeding means. A developing roller 4*d* having a stationary magnet 4*c* therein as a toner bearing member is rotated and a toner layer having a triboelectrification charge given by a developing blade 4*e* is formed on a surface of the developing roller 4*d*. The toner is transferred to the photosensitive drum 5 in accordance with the electrostatic latent image by applying a developing bias so that the toner image is visually formed.

After the voltage of a polarity opposite to a polarity of the toner image is applied to the transfer roller 24 so that the toner image is transferred to the recording medium 22, the toner left on the photosensitive drum 5 is scraped off by a cleaning blade 30*a* and is dipped by a dip sheet 30*b*. The residual toner on the photosensitive drum 5 is removed by cleaning means 30 for collecting the residual toner in a removed toner containing portion 30*c*.

Figure 13:
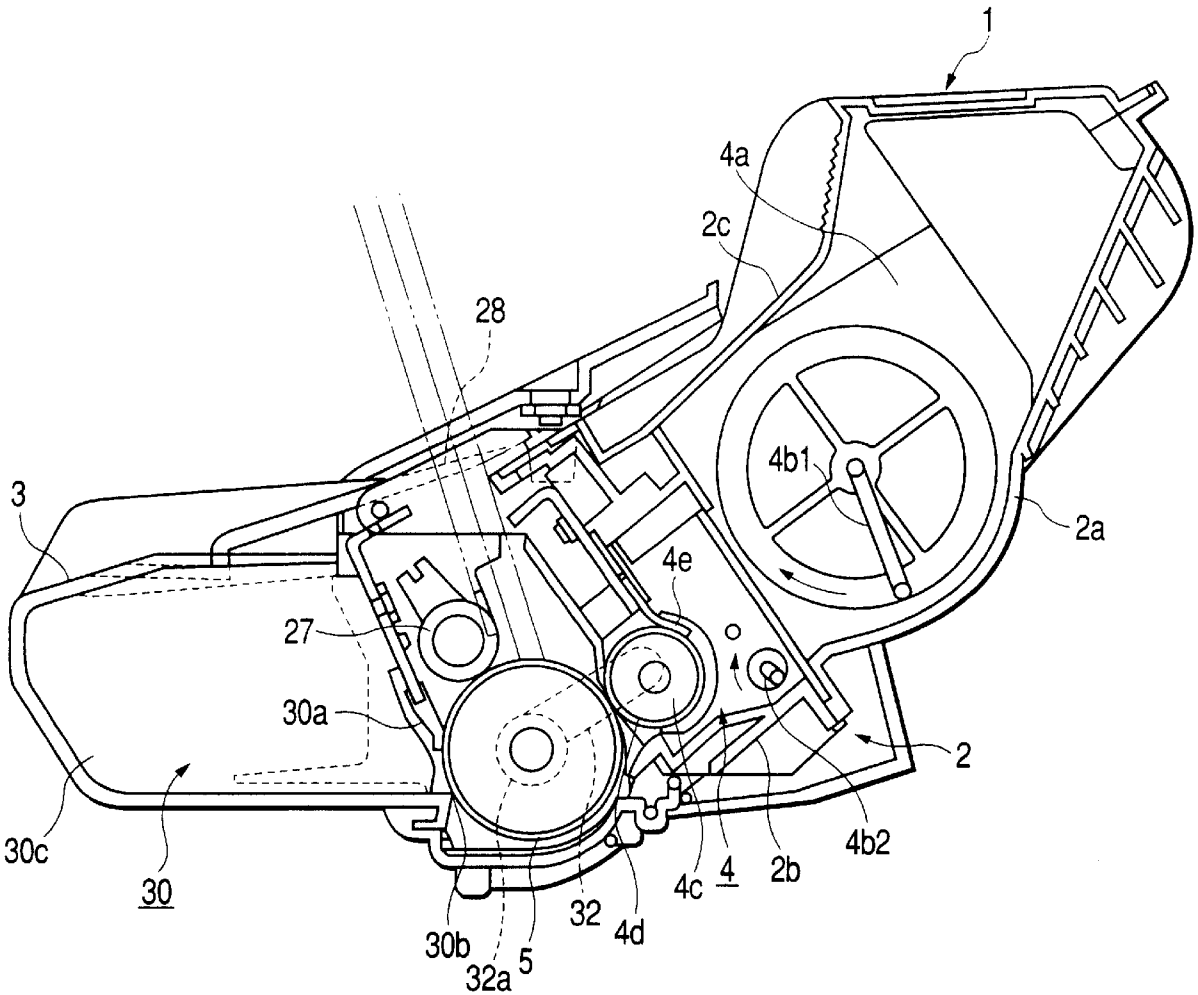
FIG. 13 is a,cross-sectional view showing a schematic construction of the process cartridge.

In the process cartridge 1 according to this embodiment, as shown in FIG. 13, the developing container 2 as a second frame is constructed by integrally welding and attaching a developing frame 2*a* having the toner containing portion 4*a*, a developing lower frame 2*b* for holding a developing member such as the developing blade 4*e* and the developing roller 4*d* constituting the developing means 4, and a cover member 2*c* for closing an opening portion of the developing frame 2*a*. The cleaning container 3 as a first frame holds respective members such as the photosensitive drum 5, the charging roller 27, the cleaning means 30. The developing container 2 and the cleaning container 3 are connected to each other by engaging pins 8 (see FIG. 11) described later as a connecting member and are integrally made into a cartridge. The cartridge is detachably mountable to cartridge mounting means (not shown) arranged in a main body A1 of the image forming apparatus.

As shown in FIG. 12, the process cartridge 1 is attached and detached by opening an openable and closable member 31 with a shaft 31*a* as a center. When the openable and closable member 31 is opened, a cartridge mounting space is arranged within the image forming apparatus main body A1. Cartridge mounting guide members are provided on frames on both left-hand and right-hand sides of this mounting space and are opposite to each other. In contrast to this, a boss 32 (see FIG. 13) is projected and formed on each of both outside faces of the process cartridge 1 in its longitudinal direction. The process cartridge 1 is inserted by moving this boss 32 along an unillustrated guide groove formed by the frame and each of the left-hand and right-hand guide members. An unillustrated concave portion is formed in a deep portion of the guide groove. The process cartridge 1 is mounted by dropping a shaft portion 32*a* of the above boss 32 into the concave portion. At this time, a drum gear 11 (see FIG. 11) attached to one end portion of the photosensitive drum 5 in its longitudinal direction is engaged with an unillustrated drive gear arranged in the image forming apparatus main body A1 so that driving force is transmitted to the photosensitive drum 5.

(Explanation of Connecting Structure Between Developing Container and Cleaning Container)

Figure 1:
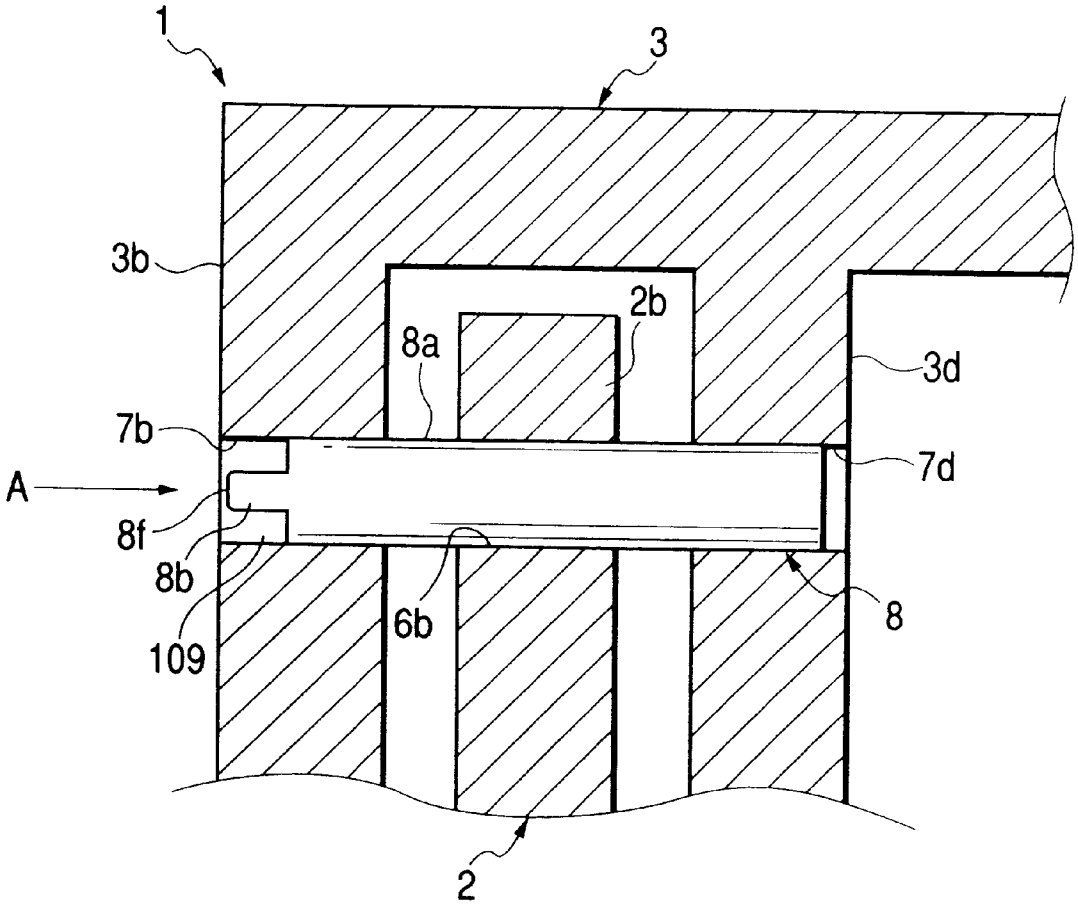
FIG. 1 is a cross-sectional view of a connecting portion of a developing container and a cleaning container using a connecting pin according to a first embodiment of the present invention.
Figure 10:
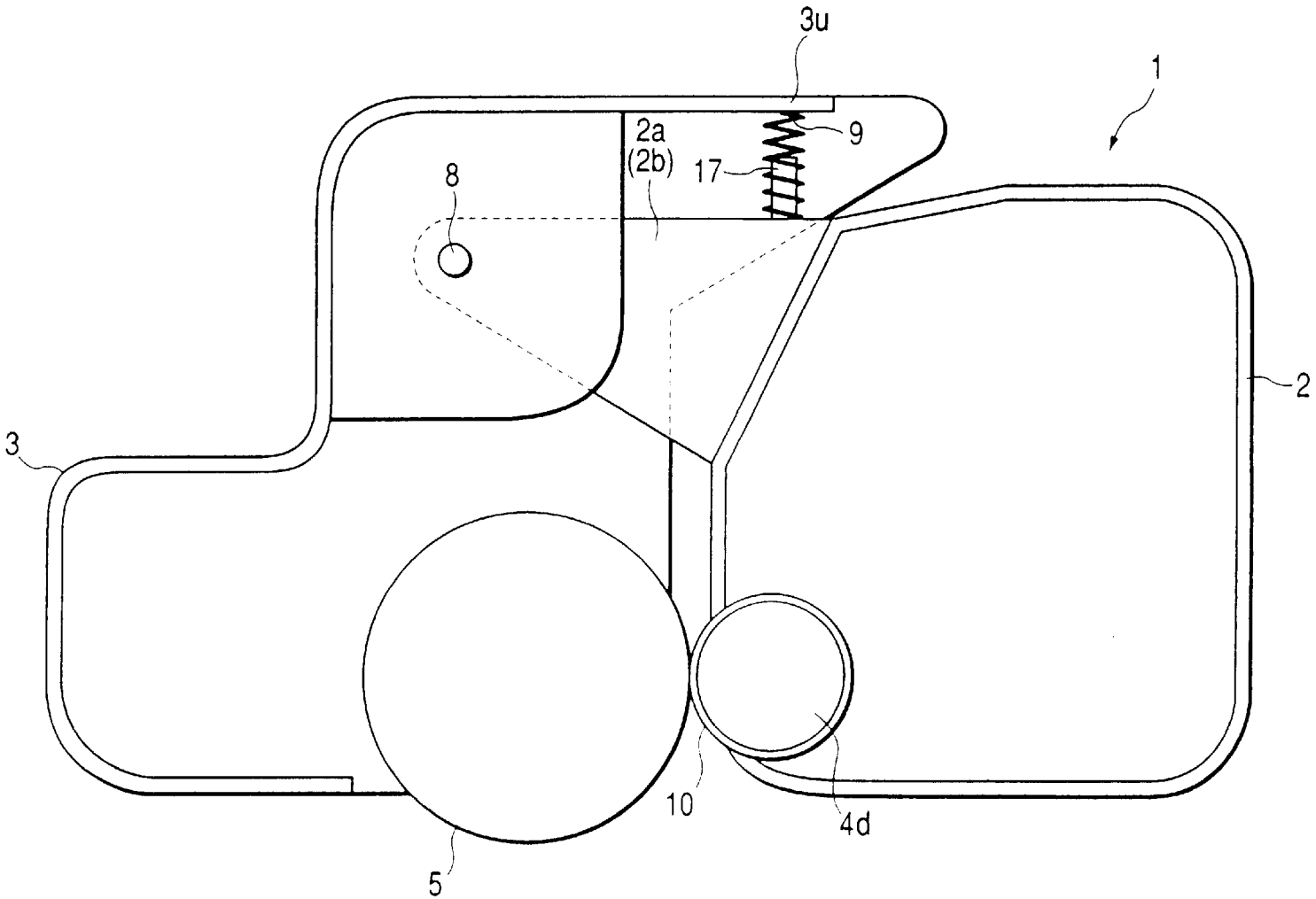
FIG. 10 is a schematic sectional view showing a connecting form of the developing container and the cleaning container in the process cartridge.
Figure 11:
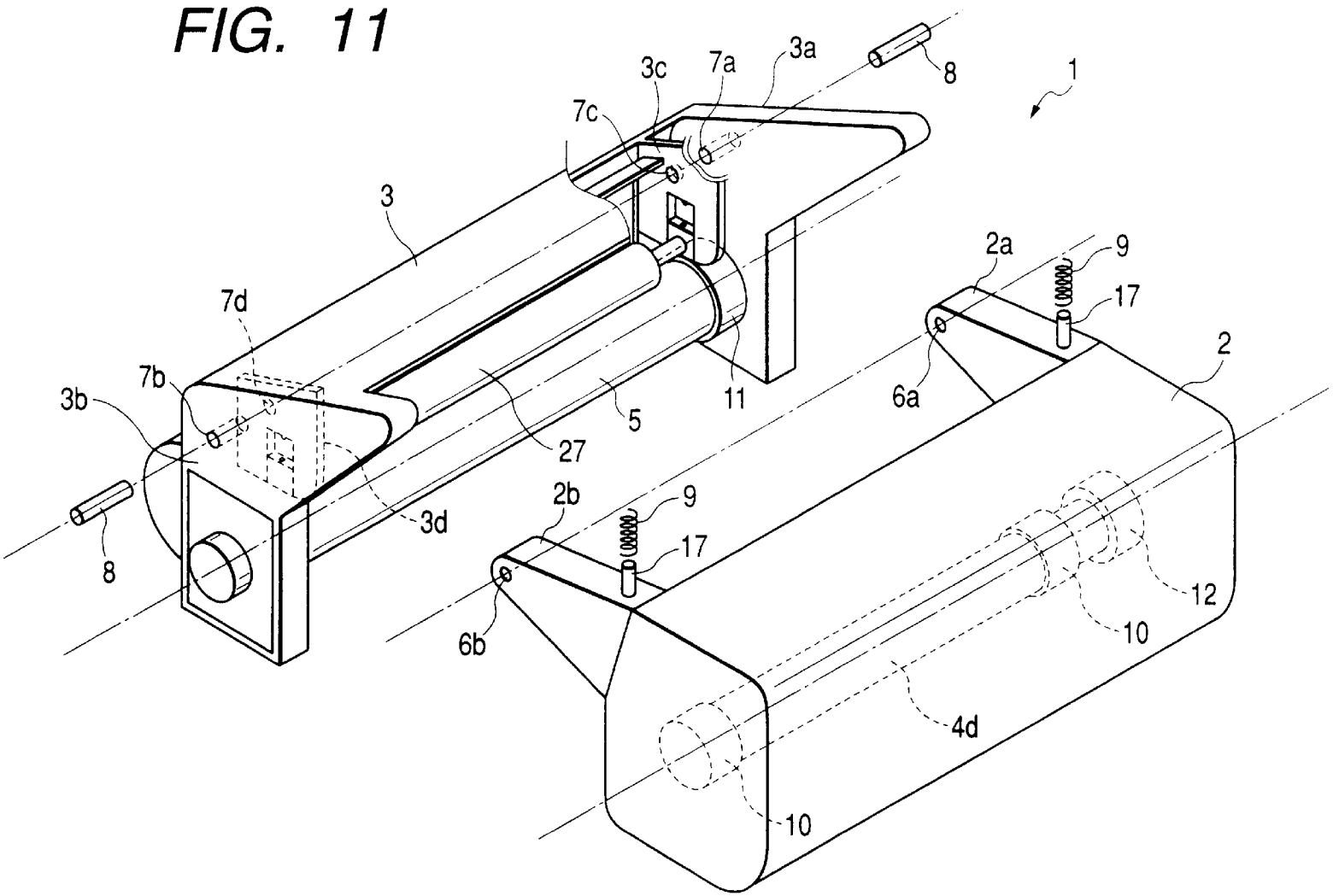
FIG. 11 is an exploded perspective view showing a connecting structure of the process cartridge.

A connecting structure between the developing container and the cleaning container in the process cartridge will next be explained by using FIGS. 10, 11 and 1. FIG. 10 is a schematic sectional view showing the connecting structure between the developing container and the cleaning container in the process cartridge. FIG. 11 is an exploded perspective view showing the connecting structure of the process cartridge shown in FIG. 10. FIG. 1 is a cross-sectional view of a connecting portion between the developing container and the cleaning container using a connecting pin.

As shown in FIGS. 10 and 11, the photosensitive drum 5 and the charging roller 27 are rotatably held in the cleaning container 3 as mentioned above. The developing roller 4*d* constituting the developing means 4 is rotatably held in the developing container 2. The drum gear 11 is arranged in a right-hand side end portion of the photosensitive drum 5. A sleeve gear 12 is arranged in a right-hand side end portion of the developing roller 4*d*. A distance holding member 10 is arranged in each of both end portions of the developing roller 4*d*. Arm portions 2*a*, 2*b* are arranged in the developing container 2. Developing side connecting holes 6*a*, 6*b* are respectively formed near the distal ends of arm portions 2*a*, 2*b*. In contrast to this, photosensitive member side connecting holes 7*a*, 7*b* are respectively formed in outer walls 3*a*, 3*b* as external sides of the cleaning container 3. Photosensitive member side connecting holes 7*c*, 7*d* are respectively formed in inner walls 3*c*, 3*d* as internal sides respectively arranged on the inside sides of the outer walls 3*a*, 3*b*.

The developing container 2 and the cleaning container 3 are rotatably connected to each other by connecting pins 8 of a round bar shape (described later). The connecting pin 8 has a connecting portion 8*a* fitted into the connecting holes 7*a*, 7*c* (7*b*, 7*d*) respectively formed in the outer walls 3*a* (3*b*) and the inner walls 3*c* (3*d*) of the cleaning container 3, and the connecting holes 6*a* (6*b*) respectively formed in the arm portions 2*a* (2*b*) of the developing container 2. The connecting portion 8*a* rotatably connects the cleaning container 3 and the developing container 2 to each other. Diametrical sizes of the connecting holes 7*a*, 7*b*, 7*c*, 7*d*, 6*a*, 6*b* and the connecting portions 8*a* are determined such that the connecting portions 8*a* are forcibly fitted into the connecting holes 7*a*, 7*b*, 7*c*, 7*d* of the cleaning container 3 and are loosely fitted into the connecting holes 6*a*, 6*b* of the developing container 2.

When the developing container 2 and the cleaning container 3 are connected to each other by the connecting pins 8, the developing container 2 and the cleaning container 3 are combined with each other in a position in which the connecting holes 6*a*, 6*b*, 7*a*, 7*b*, 7*c*, 7*d* respectively formed in the developing container 2 and the cleaning container 3 are aligned with each other in a longitudinal direction of the process cartridge 1 (an axial direction of the photosensitive drum 5). In this state, the connecting pins 8 are inserted into the connecting holes 7*b*, 6*b*, 7*d*, 7*a*, 6*a*, 7*c* arranged three by three on left-hand and right-hand sides of the process cartridge 1 in its longitudinal direction so that the developing container 2 and the cleaning container 3 are connected to each other (see FIGS. 10 and 1).

Accordingly, the connecting pins 8 are held in the cleaning container 3 and the developing container 2 is rotatably supported with respect to the cleaning container 3.

As shown in FIGS. 10 and 11, a projection 17 for a spring 9 is arranged at a proximal end of each of the arm portions 2*a*, 2*b* of the developing container 2. A D-pressurizing spring (compression coil spring) 9 is attached on the projection 17 for a spring. When the developing container 2 and the cleaning container 3 are connected to each other, the D-pressurizing spring 9 is located between the proximal end of each of the arm portions 2*a*, 2*b* of the developing container 2 and an upper wall portion 3*u* of the cleaning container 3 (see FIG. 10). Thus, the photosensitive drum 5 of the cleaning container 3 and the developing roller 4*d* within the developing container 2 abut through the distance holding member 10 against each other by a predetermined pressure. Thus, a small distance between the photosensitive drum 5 and the developing roller 4*d* is constantly held at any time and a preferable image is stably outputted.

According to this embodiment, the connecting pin 8 has the connecting portion 8*a* rotatably connecting the developing container 2 and the cleaning container 3 to each other as shown in FIGS. 1, 2, 3A to 3C and 4A to 4C. In the connecting pin 8, a head portion 8*b* (8*c*, 8*d*) having a diameter smaller than a diameter of the connecting portion 8*a* is arranged in an end portion of the connecting portion 8*a* on a side of the outer wall 3*b* of the cleaning container 3. The developing container 2 and the cleaning container 3 are connected to each other by using this connecting pin 8.

Figure 3A:
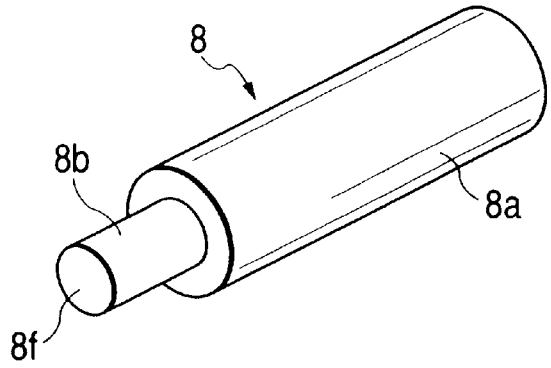
FIGS. 3A, 3B and 3C are perspective views of the connecting pin according to the first embodiment of the present invention.

The connecting pin 8 according to this embodiment has a connecting portion 8*a* of a round bar shape fitted into connecting holes 7*b*, 7*d* formed in the outer wall 3*b* and the inner wall 3*d* of the cleaning container 3, and a connecting hole 6*b* formed in the arm portion 2*b* of the developing container 2 as shown in FIGS. 1 and 3A. The connecting portion 8*a* rotatably connects the cleaning container 3 and the developing container 2 to each other. The head portion 8*b* having a diameter smaller than a diameter of the connecting portion 8*a* is arranged in an end portion (an end portion on a side opposed to an insertion direction) of the connecting portion 8*a* on a side of the outer wall 3*b* of the cleaning container 3. In a state in which the connecting portion 8*a* is inserted into each of connecting holes 7*b*, 6*b*, 7*d* of the cleaning container 3 and the developing container 2, and the developing container 2 and the cleaning container 3 are completely connected to each other, the head portion 8*b* is formed such that an end surface 8*f* on a side of the outer wall 3*b* of the cleaning container 3 is substantially flush with the outer wall 3*b* of the cleaning container 3 so as not to project from the outer wall 3*b*. Further, the head portion 8*b* is arranged in an end portion of the connecting portion 8*a* on the side of the outer wall 3*b* of the cleaning container 3 such that a space 109 is formed between the head portion 8*b* and the connecting hole 7*b* on the side of the outer wall 3*b* of the cleaning container 3.

In a connecting method of the developing container 2 and the cleaning container 3 using the connecting pin 8, diametrical sizes of the connecting holes 7*b*, 6*b*, 7*d* and the connecting portion 8*a* are determined such that the connecting portion 8*a* is forcibly fitted into the connecting holes 7*b*, 7*d* formed in the outer wall 3*b* and the inner wall 3*d* of the cleaning container 3, and is loosely fitted into the connecting hole 6*b* formed in the arm portion 2*b* of the developing container 2.

When the developing container 2 and the cleaning container 3 are connected to each other by the connecting pin 8, the connecting portion 8*a* is inserted into each of the connecting holes 7*b*, 6*b*, 7*d* of the cleaning container 3 and the developing container 2 from a side opposed to the head portion 8*b* in the direction indicated by an arrow A. Thus, the developing container 2 and the cleaning container 3 are rotatably connected to each other. Thus, the connecting pin 8 is held in the cleaning container 3 and the developing container 2 is rotatably supported with respect to the cleaning container 3.

When the connecting portion 8*a* of the connecting pin 8 is inserted into each of the connecting holes 7*b*, 6*b*, 7*d* of the cleaning container 3 and the developing container 2 so that the developing container 2 and the cleaning container 3 are completely connected to each other, the end surface 8*f* of the head portion 8*b* of the connecting pin 8 has nothing to be projected from the outer wall 3*b* of the cleaning container 3. Further, the space 109 is defined between the head portion 8*b* and the connecting hole 7*b* formed in the outer wall 3*b* of the cleaning container 3.

Figure 2:
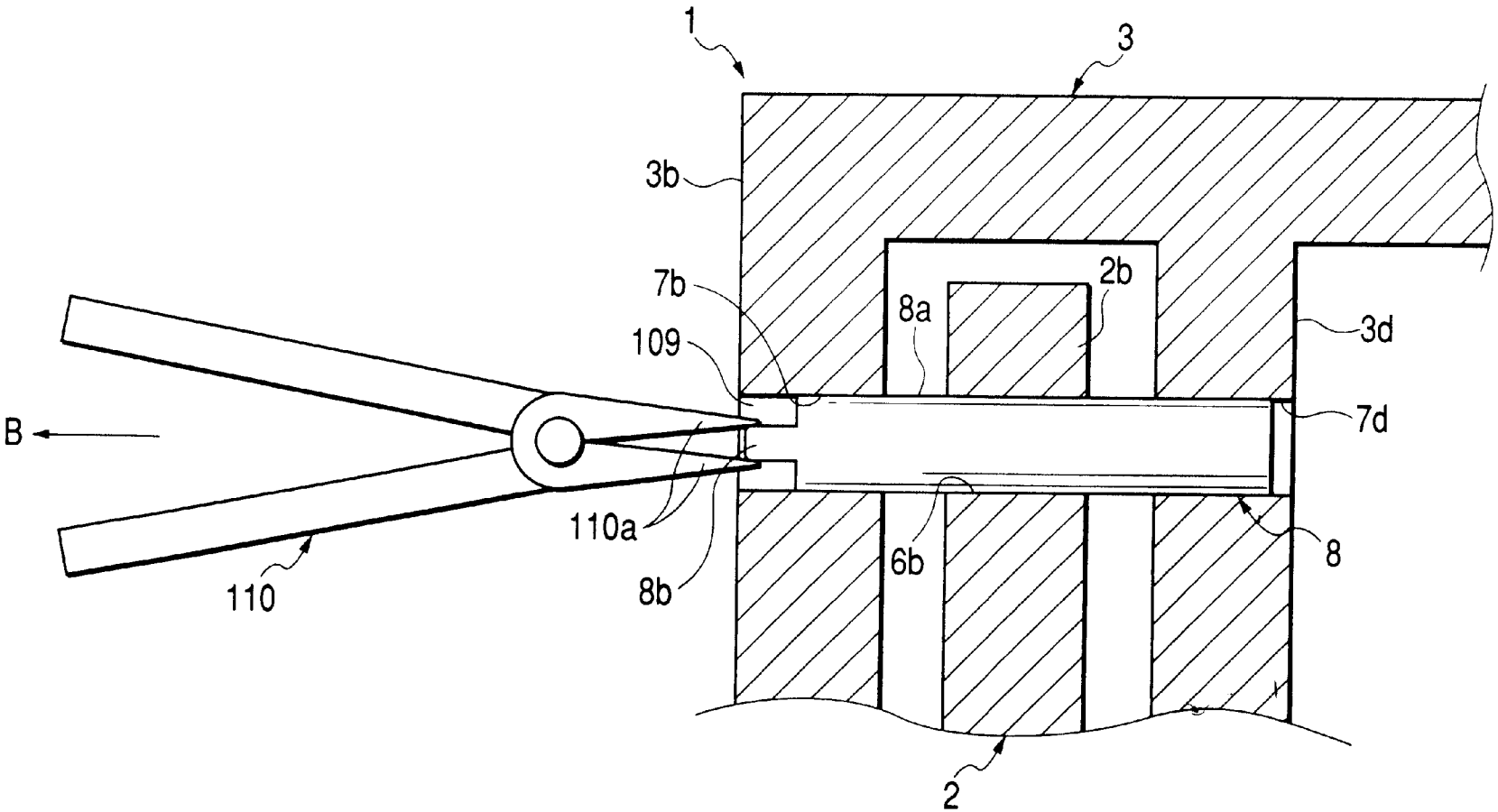
FIG. 2 is a view for explaining that the connecting pin shown in FIG. 1 is pulled out.

When the process cartridge 1 is disassembled by pulling the connecting pin 8 out of the cleaning container 3 of the process cartridge 1, tip ends 110*a* of a tool 110 (pliers is used in this embodiment) is inserted into the space 109 between the head portion 8*b* and the connecting hole 7*b* formed in the outer wall 3*b* of the cleaning container 3 as shown in FIG. 2. The head portion 8*b* is then gripped by the tip ends 110*a* of the tool 110 and the connecting pin 8 is pulled out of the connecting hole 7*b* in the direction indicated by an arrow B opposed to the insertion direction.

Figure 3B:
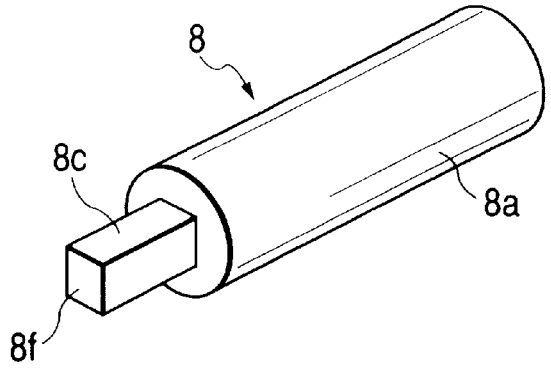
Figure 3C:
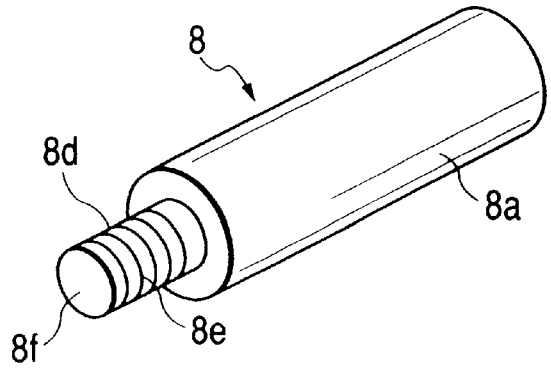

According to this embodiment, the head portion 8*b* of the connecting pin 8 is formed in a cylindrical shape having a circular section, but the head portion 8*b* is not limited to this shape. For example, a head portion 8*c* of a prismatic pillar shape having a polygonal section may be also used as shown in FIG. 3B.

As shown in FIGS. 3C, 4A, 4B and 4C, a screw portion 8*e* may be also formed on a circumferential surface of the head portion 8*d* formed in a cylindrical shape having a circular section. In this case, a tool 111 may be engaged with the head portion 8*d* within the space 109 between this head portion 8*d* and the connecting hole 7*b* formed in the outer wall 3*b* of the cleaning container 3, and the connecting pin 8 may be pulled out.

Figure 4A:
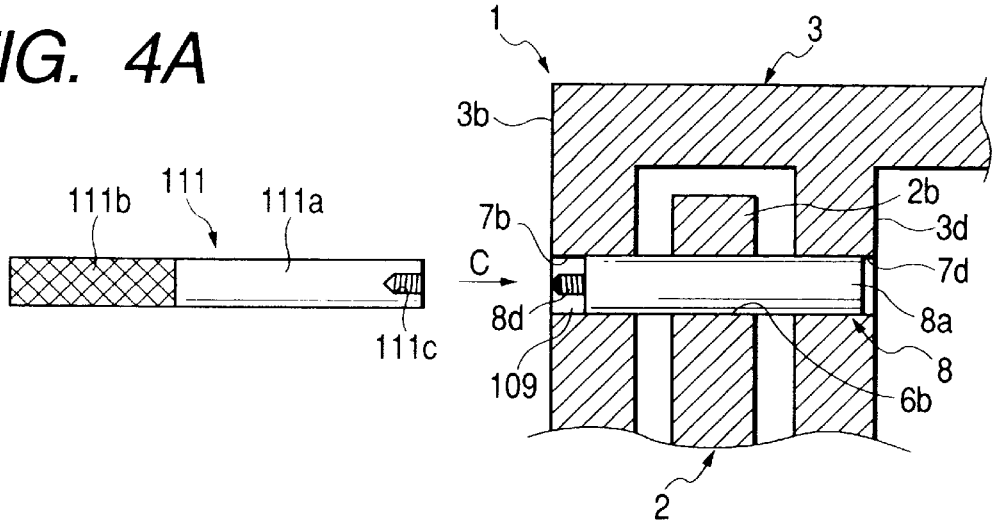
FIGS. 4A, 4B and 4C are views for explaining that the connecting pin having a screw portion shown in FIGS. 3A, 3B and 3C is pulled out.
Figure 4B:
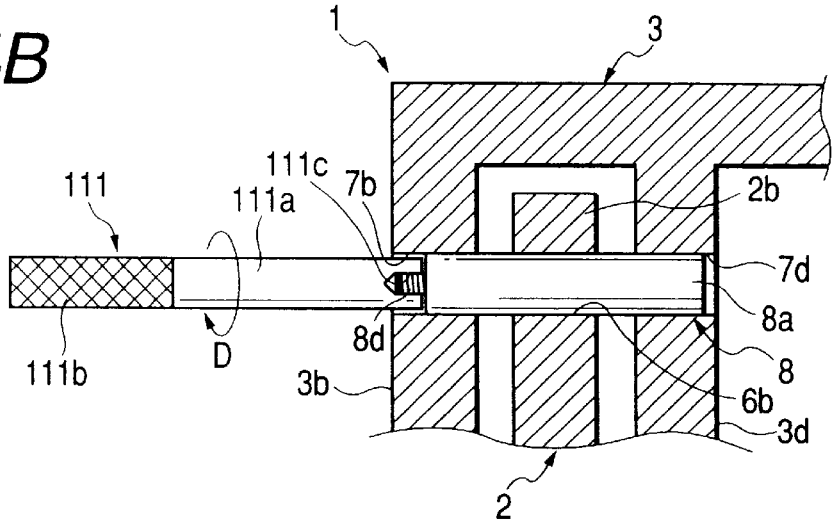
Figure 4C:
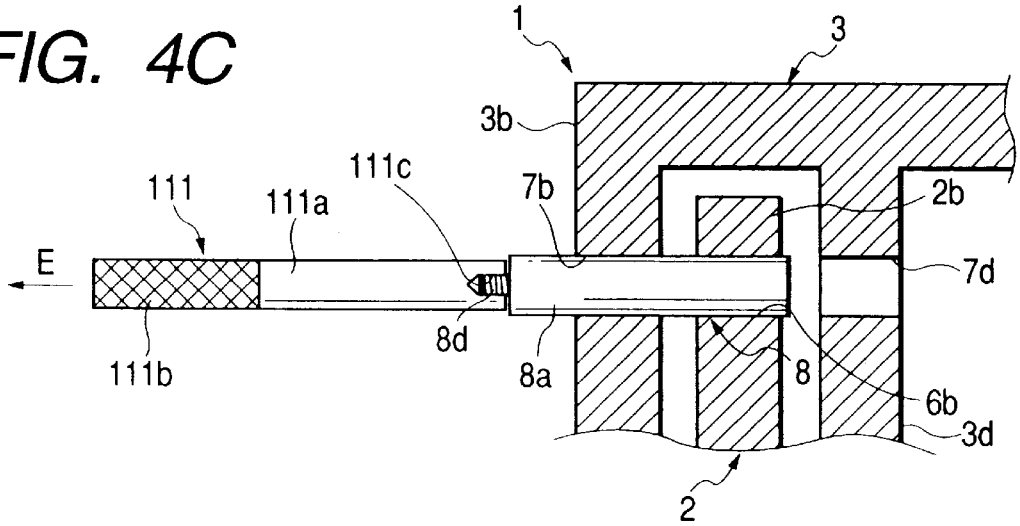

As shown in FIGS. 4A, 4B and 4C, the tool 111 has an engaging portion 111*a* having a diameter smaller than the diameter of the connecting hole 7*b* formed in the outer wall 3*b* of the cleaning container 3, and a grip portion 111*b* for holding the tool 111. The engaging portion 111*a* has a screw portion 111*c* engaged with the head portion 8*d* of the connecting pin 8 and formed at a tip end of the engaging portion 111*a*.

As shown in FIGS. 4A, 4B and 4C, when the connecting pin 8 is pulled out by using the tool 111, the tool 111 approaches the head portion 8*d* from a direction indicated by the arrow C as an insertion direction of the connecting pin 8 (see FIG. 4A). The engaging portion 111*a* of the tool 111 is rotated in a direction indicated by the arrow D around an axial direction of the connecting pin 8. Thus, the screw portion 111*c* of the engaging portion 111*a* is engaged with the screw portion 8*e* of the head portion 8*d* within the space 109 (see FIG. 4B). Then, the above tool 111 is pulled out in a direction indicated by the arrow E opposed to the insertion direction of the connecting pin 8 (see FIG. 4C) so that the connecting pin 8 is completely pulled out.

In the above examples, the tip ends 110*a* of the tool 110 are inserted into the space 109 between the head portion 8*b*, 8*c* of the connecting pin 8 and the connecting hole 7*b* formed in the outer wall 3*b* of the cleaning container 3. The connecting pin 8 is then pulled out of the connecting hole 7*b* of the cleaning container 3 by gripping the head portion 8*b*, 8*c* by the tip ends 110*a* of the tool 110. Otherwise, the screw portion 111*c* of the engaging portion 111*a* of the tool 111 is engaged with the screw portion 8*e* of the head portion 8*d* within the space 109 between the head portion 8*d* of the connecting pin 8 and the connecting hole 7*b* formed in the outer wall 3*b* of the cleaning container 3. Then, the connecting pin 8 is pulled out of the connecting hole 7*b* of the cleaning container 3.

Figure 5:
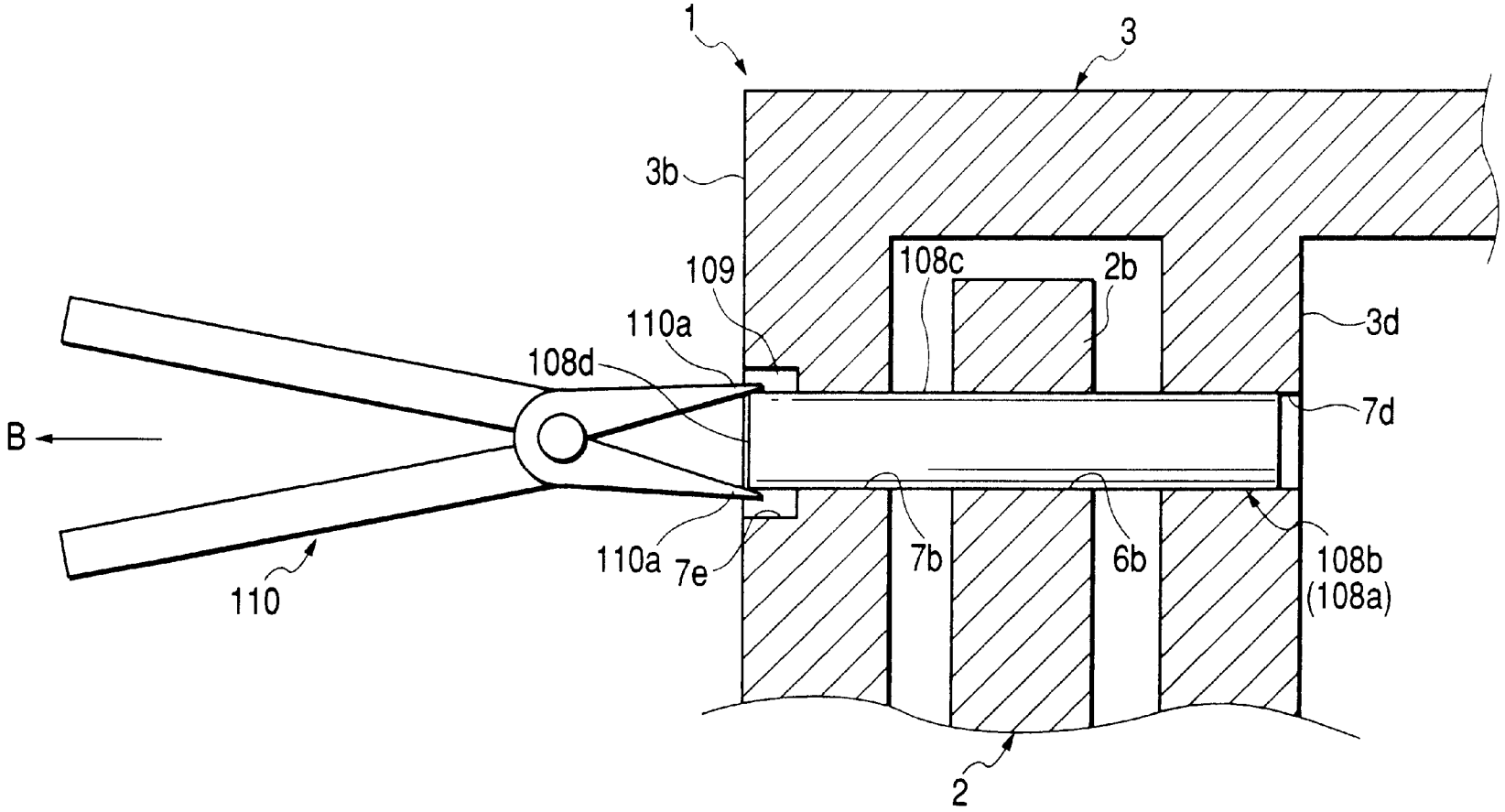
FIG. 5 is a cross-sectional view of the connecting portion of the developing container and the cleaning container having a stepped hole in a process cartridge according to the, first embodiment of the present invention.
Figure 14:
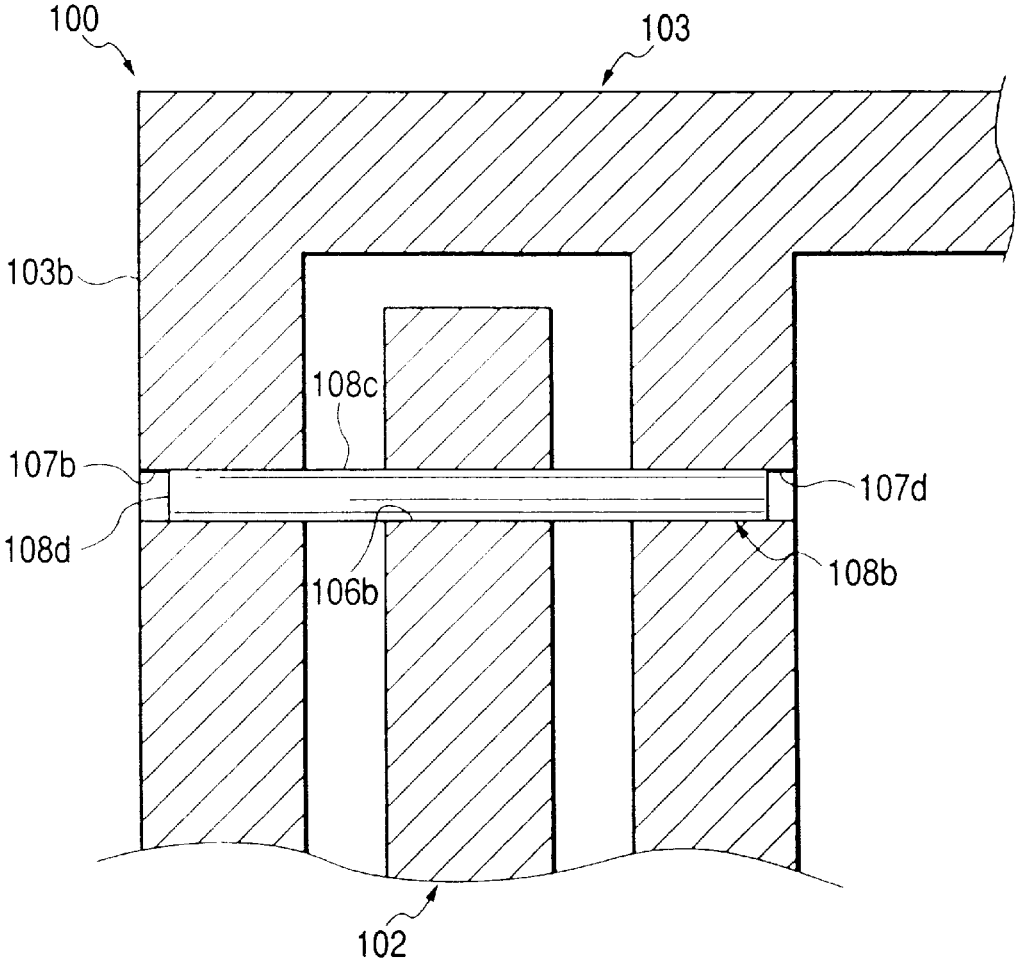
FIG. 14 PRIOR ART
FIG. 14 is a cross-sectional view of a connecting pin portion of the process cartridge.
Figure 15A:
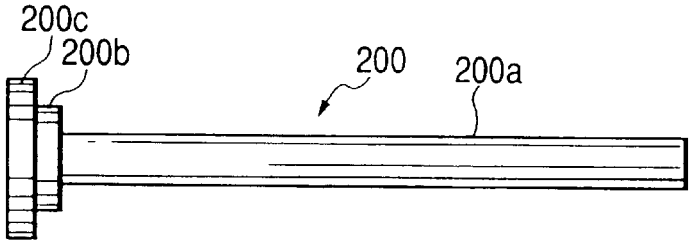
FIG. 15A PRIOR ART
FIG. 15A is a perspective view of the connecting pin improving the disassembly property of the process cartridge.
Figure 15B:
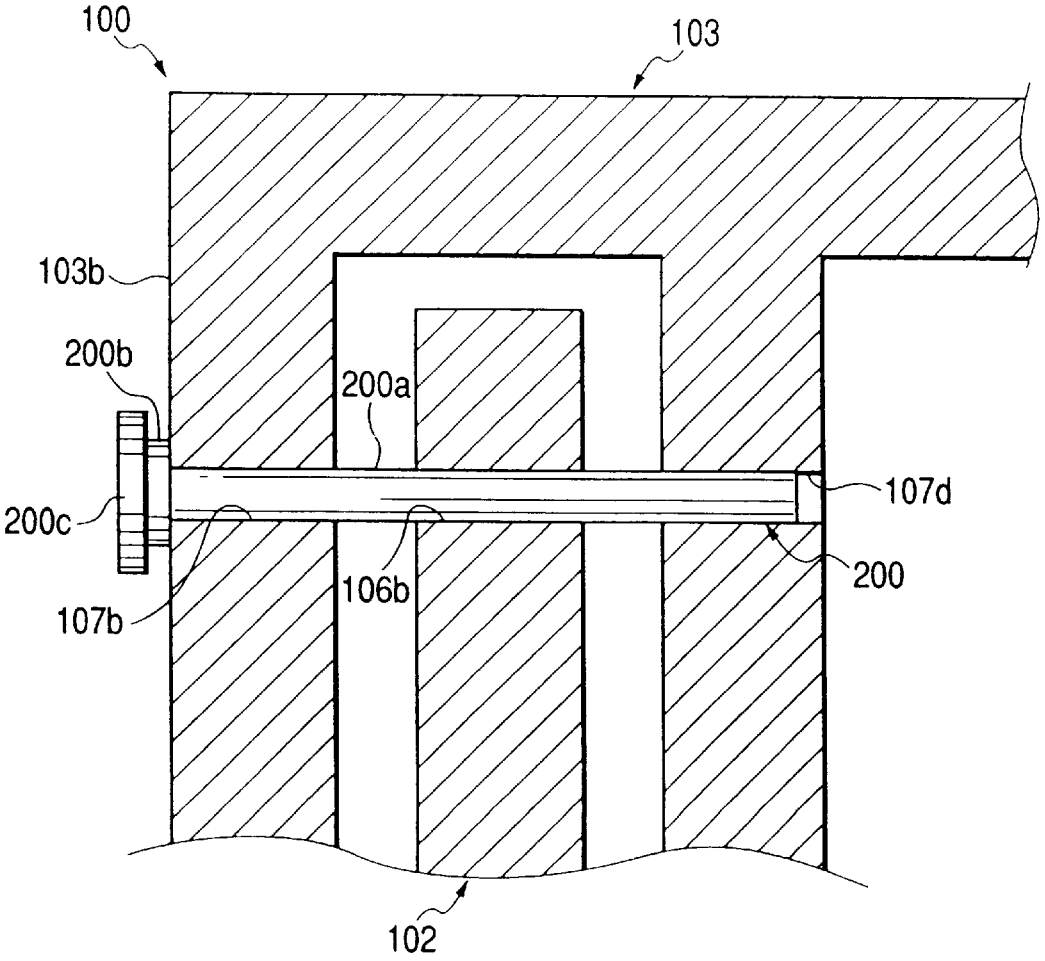
FIG. 15B PRIOR ART
FIG. 15B is a cross-sectional view of a connecting pin portion connecting the developing container and the cleaning container using the connecting pin.
Figure 16:
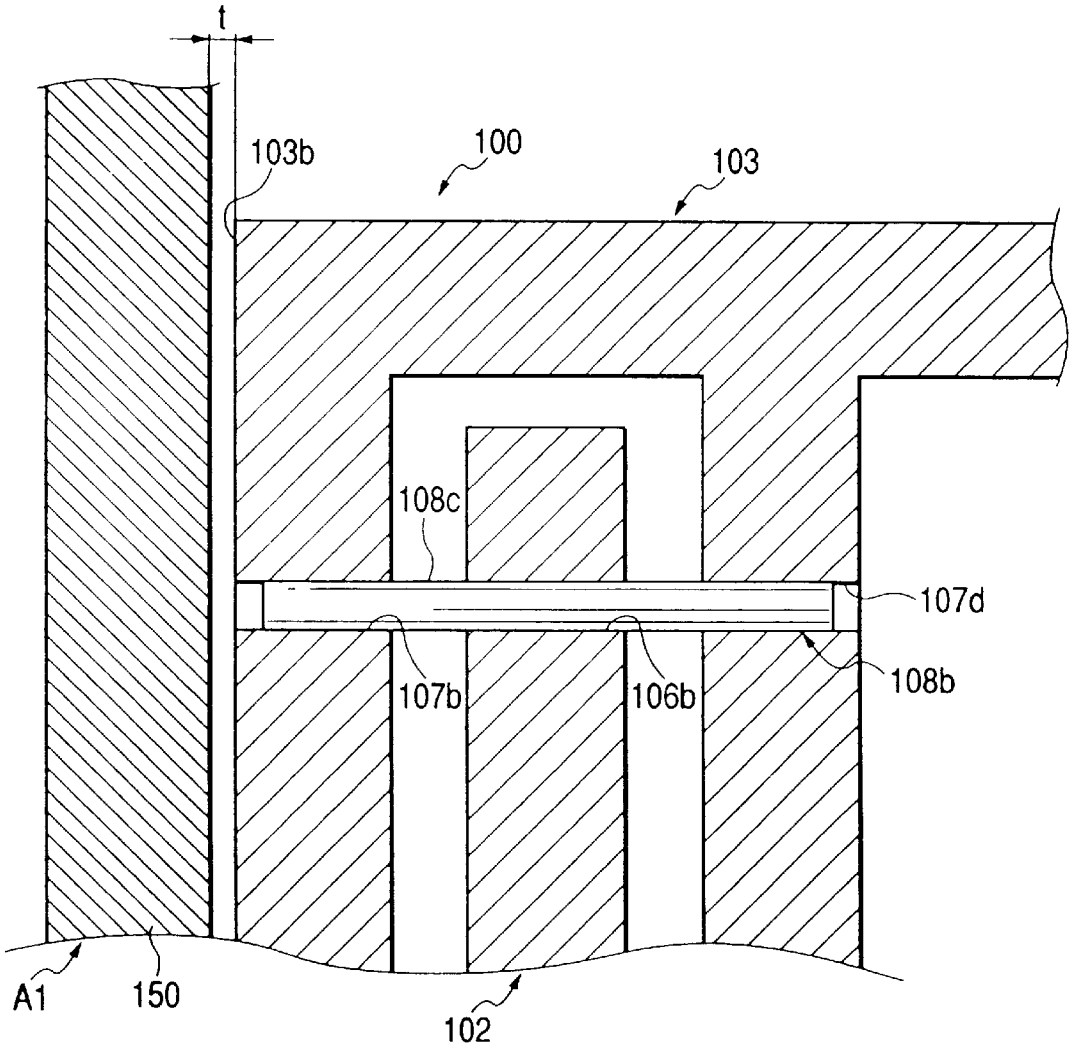
FIG. 16 PRIOR ART
FIG. 16 is an explanatory view for explaining a clearance caused between the process cartridge and a main body of an image forming apparatus in a longitudinal direction of the process cartridge.

In addition to the above examples, when the developing container 2 and the cleaning container 3 are rotatably connected to each other by using a connecting pin 108*b* (108*a*) of a round bar shape already described (see FIG. 14), a stepped hole 7*e* is formed on a side opposed to the insertion direction of the connecting pin 108*b* (108*a*) in the connecting hole 7*b* on a side of the outer wall 3*b* of the cleaning container 3 and has a diameter larger than the diameter of the connecting hole 7*b* as shown in FIG. 5. Thus, a space 109 is defined on the side of the outer wall 3*b* of the cleaning container 3. The tip ends 110*a* of the tool 110 are then inserted into this space 109, and one end (an end portion on the side of an end surface 108*d*) of the connecting portion 108*c* on the side of the outer wall 3*b* of the cleaning container 3 is gripped by the tip ends 110*a* of the tool 110. Thus, the connecting pin 108*b* (108*a*) may be pulled out of the connecting hole 7*b* of the cleaning container 3.

According to this embodiment, the developing container 2 and the cleaning container 3 in the process cartridge 1 are rotatably connected to each other by the connecting pin 8 having the head portion 8*b*, 8*c*, 8*d* in which the space 109 is defined between the head portion 8*b*, 8*c*, 8*d* and the connecting hole 7*b* formed on the side of the outer wall 3*b* of the cleaning container 3. Accordingly, the connecting pin 8 can be pulled out by gripping the head portion 8*b*, 8*c*, 8*d* of the connecting pin 8 by the tool 110, 111 within this space 109 and pulling the head portion in a direction opposed to the insertion direction. Therefore, the process cartridge 1 can be easily disassembled without damaging the cleaning container 3, and the cleaning container 3 and the connecting pin 8 can be reused. Further, since no end surface 8*f* of the connecting pin 8 is projected from the outer wall 3*b* of the cleaning container 3, the image forming apparatus main body A1 and the process cartridge 1 can be made compact.

Further, the space 109 for gripping one end of the connecting portion 108*c* of the connecting pin 108*b* by the tip ends 110*a* of the tool 110 is defined by forming the stepped hole 7*e* having a diameter larger than the diameter of the connecting hole 7*b* on the side of the outer wall 3*b* of the cleaning container 3. Accordingly, the connecting pin 108*b* can be pulled out by gripping one end of the connecting pin 108*b* by the tool 110 within the space 109 and pulling this one end in the direction opposed to the insertion direction. Therefore, the process cartridge 1 can be easily disassembled without damaging the cleaning container 3, and the cleaning container 3 and the connecting pin 108*b* can be reused. Further, since no end surface 108*d* of the connecting pin 108*b* is projected from the outer wall 3*b* of the cleaning container 3, the image forming apparatus main body A1 and the process cartridge 1 can be made compact.

Figure 6A:
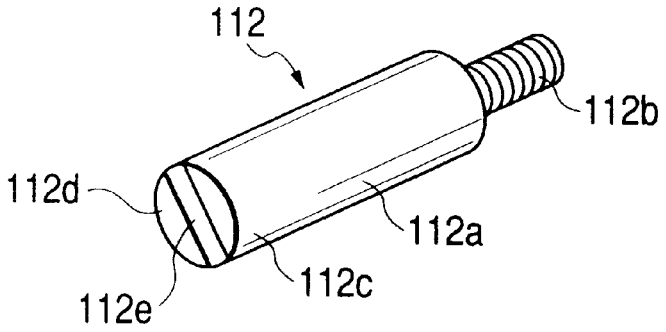
FIG. 6A is a perspective view of a connecting pin according to a second embodiment of the present invention.
Figure 6B:
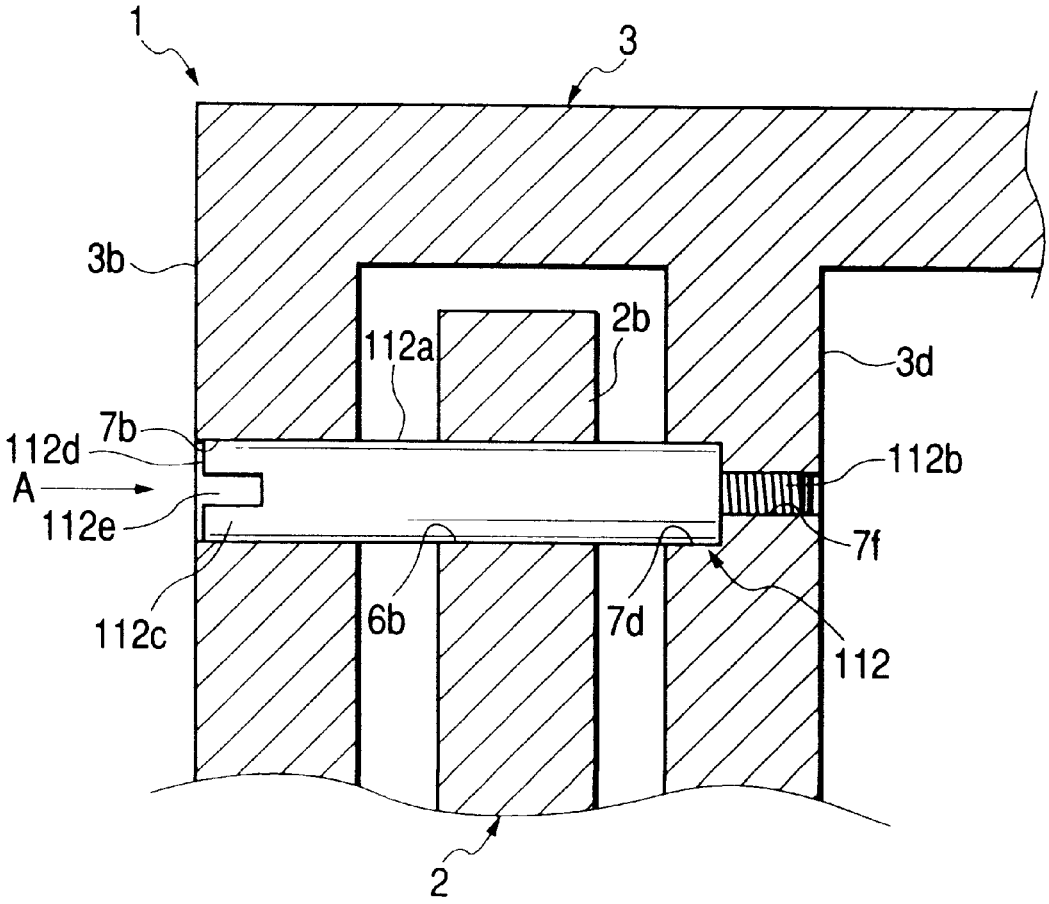
FIG. 6B is a cross-sectional view of a connecting portion of the developing container and the cleaning container using this connecting pin.
Figure 7A:
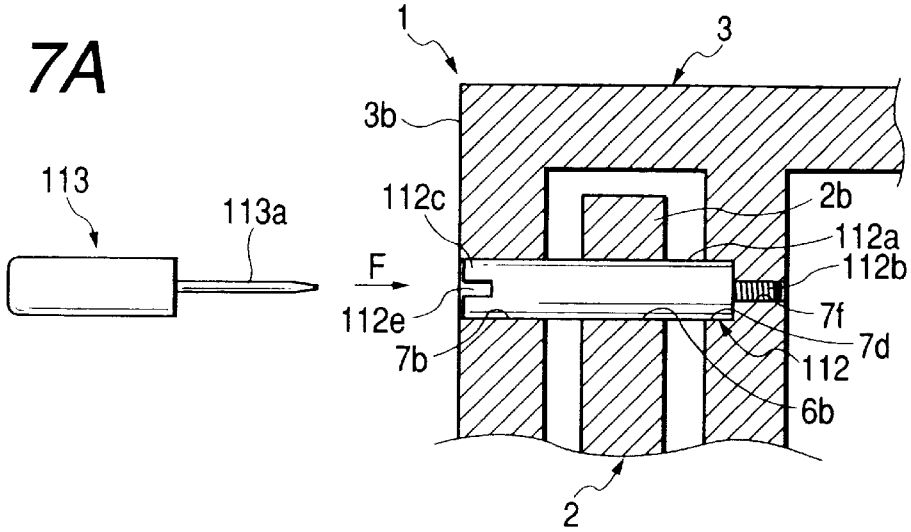
FIGS. 7A, 7B and 7C are views for explaining that the connecting pin shown in FIGS. 6A and 6B is pulled out.
Figure 7B:
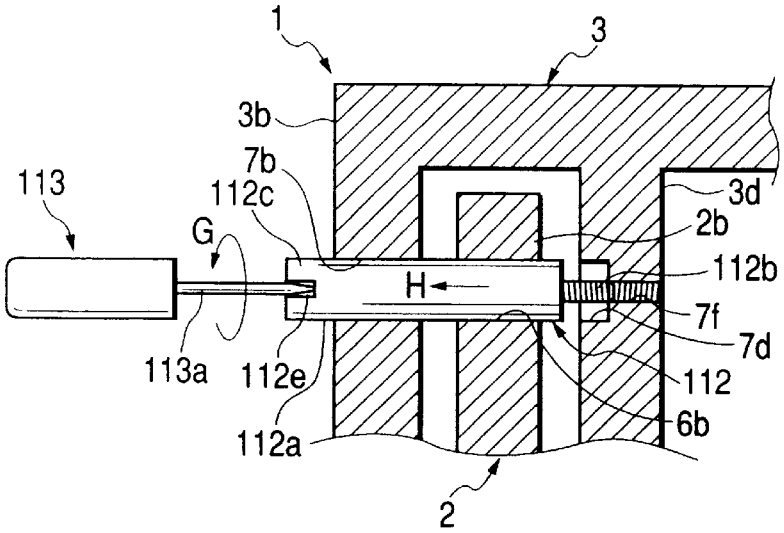
Figure 7C:
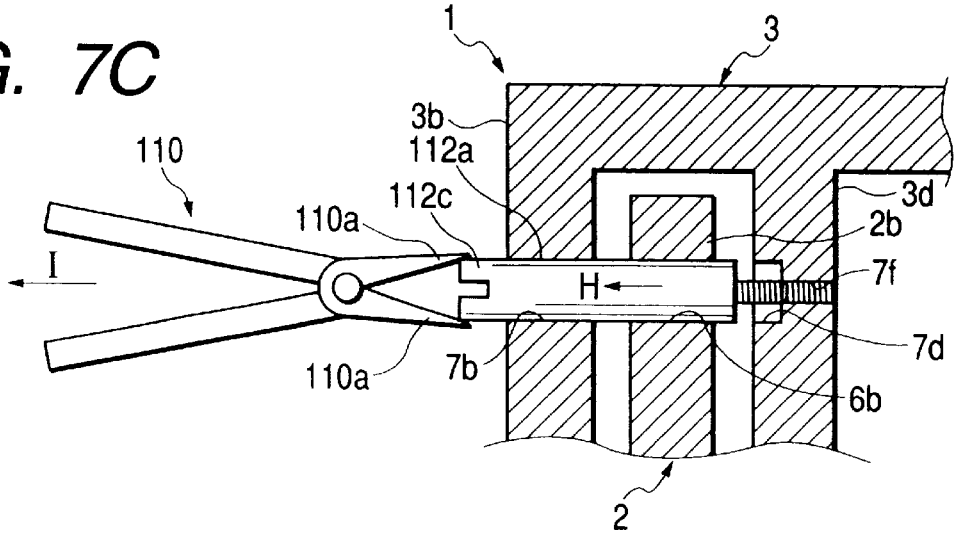

A second embodiment will next be explained with reference to FIGS. 6A, 6B, 7A, 7B and 7C. FIG. 6A is a perspective view of a connecting pin according to this embodiment. FIG. 6B is a cross-sectional view of a connecting portion of the developing container and the cleaning container using the connecting pin. FIGS. 7A, 7B and 7C are views for explaining how the connecting 5 pin according to this embodiment is pulled out.

According to this embodiment, members common to those in the above first embodiment are designated by the same reference numerals, and their explanations are omitted here. Further, connecting structures of the cleaning container and the developing container using the respective connecting pins arranged on both sides of the process cartridge in its longitudinal direction are the same. Accordingly, the connecting structure of the cleaning container and the developing container using one connecting pin will be explained according to this embodiment.

A connecting pin 112 according to this embodiment has a connecting portion 112*a* of a round bar shape fitted into connecting holes 7*b*, 7*d* formed in an outer wall 3*b* and an inner wall 3*d* of the cleaning container 3, and a connecting hole 6*b* formed in an arm portion 2*b* of the developing container 2. The connecting portion 112*a* rotatably connects the cleaning container 3 and the developing container 2 to each other. A screw portion 112*b* is arranged on a side of the inner wall 3*d* of the cleaning container 3 in the connecting portion 112*a* and is fastened to a screw hole portion 7*f* formed in an outside portion of the connecting hole 7*d* in the inner wall 3*d* of the cleaning container 3. A groove 112*e* as a polygonal hole is formed on an end surface (an end surface on a side opposed to an insertion direction) 112*d* of a head portion 112*c* on a side of the outer wall 3*b* of the cleaning container 3 in the connecting portion 112*a*. The connecting portion 112*a* is formed such that the end surface 112*d* of the head portion 112*c* is substantially flush with the outer wall 3*b* of the cleaning container 3 so as not to project from the outer wall 3*b* in a state in which the screw portion 112*b* is fastened to the screw hole portion 7*f* of the cleaning 3, and the developing container 2 and the cleaning container 3 are completely connected to each other. As shown in FIGS. 7A, 7B and 7C, the groove 112*e* arranged on the end surface 112*d* of the head portion 112*c* is formed in a shape engageable with a tip end 113*a* of a tool 113 (a minus screw driver is used in this embodiment) used when the connecting pin 112 is pulled out of the process cartridge 1.

In a connecting method of the developing container 2 and the cleaning container 3 using the connecting pin 112, diametrical sizes of the connecting holes 7*b*, 6*b*, 7*d* and the connecting portion 112*a* are determined such that the connecting portion 112*a* is forcibly fitted into the connecting holes 7*b*, 7*d* formed in the outer wall 3*b* and the inner wall 3*d* of the cleaning container 3, and is loosely fitted into the connecting hole 6*b* formed in the arm portion 2*b* of the developing container 2.

When the developing container 2 and the cleaning container 3 are connected to each other by using the connecting pin 112, the connecting portion 112*a* is inserted into each of the connecting holes 7*b*, 6*b*, 7*d* of the cleaning container 3 and the developing container 2 from a side of the screw portion 112*b* in the direction indicated by an arrow A (FIG. 6B). Further, the connecting portion 112*a* is rotated around an axial direction and the screw portion 112*b* is fastened to the screw hole portion 7*f* in the inner wall 3*d* of the cleaning container 3. Thus, the connecting pin 112 is held by the cleaning container 3, and the developing container 2 is rotatably supported with respect to the cleaning container 3.

Thus, when the connecting portion 112*a* of the connecting pin 112 is inserted into each of the connecting holes 7*b*, 6*b*, 7*d* of the cleaning container 3 and the developing container 2 and the screw portion 112*b* of the connecting pin 112 is fastened to the screw hole portion 7*f* of the cleaning container 3, and the developing container 2 and the cleaning container 3 are completely connected to each other, no end surface 112*d* of the head portion 112*c* of the connecting pin 112 is projected from the outer wall 3*b* of the cleaning container 3.

As shown in FIGS. 7A, 7B and 7C, when the process cartridge 1 is disassembled by pulling the connecting pin 112 out of the cleaning container 3 of the process cartridge 1, the tool 113 approaches from a direction indicated by the arrow F as the insertion direction of the connecting pin 112 to pull out the connecting pin 112. The tip end 113*a* of the tool 113 is then engaged with the groove 112*e* of the head portion 112*c* (see FIG. 7A). Thereafter, the tool 113 is rotated in a direction indicated by the arrow G opposed to a rotating direction of the tool on fastening the connecting pin 112 (see FIG. 7B). Thus, the screw portion 112*b* of the connecting pin 112 is pushed out from the screw hole portion 7*f* of the cleaning container 3 in a thrust direction indicated by the arrow H of the screw. Thereafter, the connecting pin 112 is pulled out in a direction indicated by the arrow I opposed to the insertion direction by gripping the head portion 112*c* of the connecting pin 112 by the tool 110 such as pliers so that the connecting pin 112 is completely pulled out.

According to this embodiment, the groove 112*e* formed on the end surface 112*d* of the connecting pin 112 is formed in a polygonal shape engageable with the tool 113 for rotating the connecting pin 112. However, an unillustrated rib as a polygonal boss may be also formed. In a pulling-out method at this time, the rib is gripped by a tool such as pliers, and the tool is then rotated so that the connecting pin 112 is pulled out.

According to this embodiment, the screw hole portion 7*f* is formed in the inner wall 3*d* of the cleaning container 3. However, an unillustrated screw hole portion may be also formed in the outer wall 3*b* of the cleaning container 3, and a screw portion fastened to this screw hole portion may be formed in a position of the connecting pin 112 opposed to this screw hole portion.

According to this embodiment, the screw hole portion 7*f* is formed in the inner wall 3*d* of the cleaning container 3, and the screw portion 112*b* of the connecting pin 112 is fastened to the hole portion 7*f*. However, if the screw portion 112*b* of the connecting pin 112 is a self tapping screw, it is sufficient to form a prepared hole in the inner wall 3*d* of the cleaning container 3.

Thus, according to this embodiment, the screw portion 112*b* is arranged on a side of the inner wall 3*d* of the cleaning container 3, and the developing container 2 and the cleaning container 3 in the process cartridge 1 are rotatably connected to each other by the connecting pin 112 having the groove 112*e* on the end surface 112*d* on a side of the outer wall 3*b* of the cleaning container 3. Accordingly, the connecting pin 112 can be pulled out by engaging the tool 113 with the groove 112*e* and rotating the connecting pin 112 in the 5 direction opposed to the insertion direction. Therefore, the process cartridge 1 can be easily disassembled without damaging the cleaning container 3, and the cleaning container 3 and the connecting pin 112 can be reused. Further, since no end surface 112*d* of the connecting portion 112*a* of the connecting pin 112 is projected from the outer wall 3*b* of the cleaning container 3, the image forming apparatus main body A1 and the process cartridge 1 can be made compact.

Figure 8A:
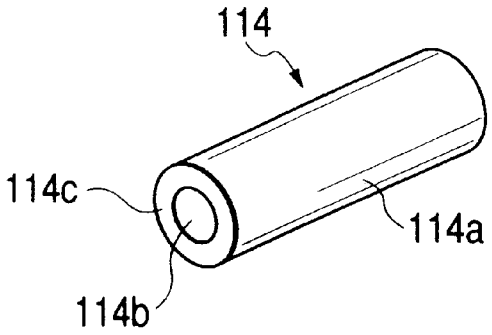
FIG. 8A is a perspective view of a connecting pin according to a third embodiment of the present invention.
Figure 8B:
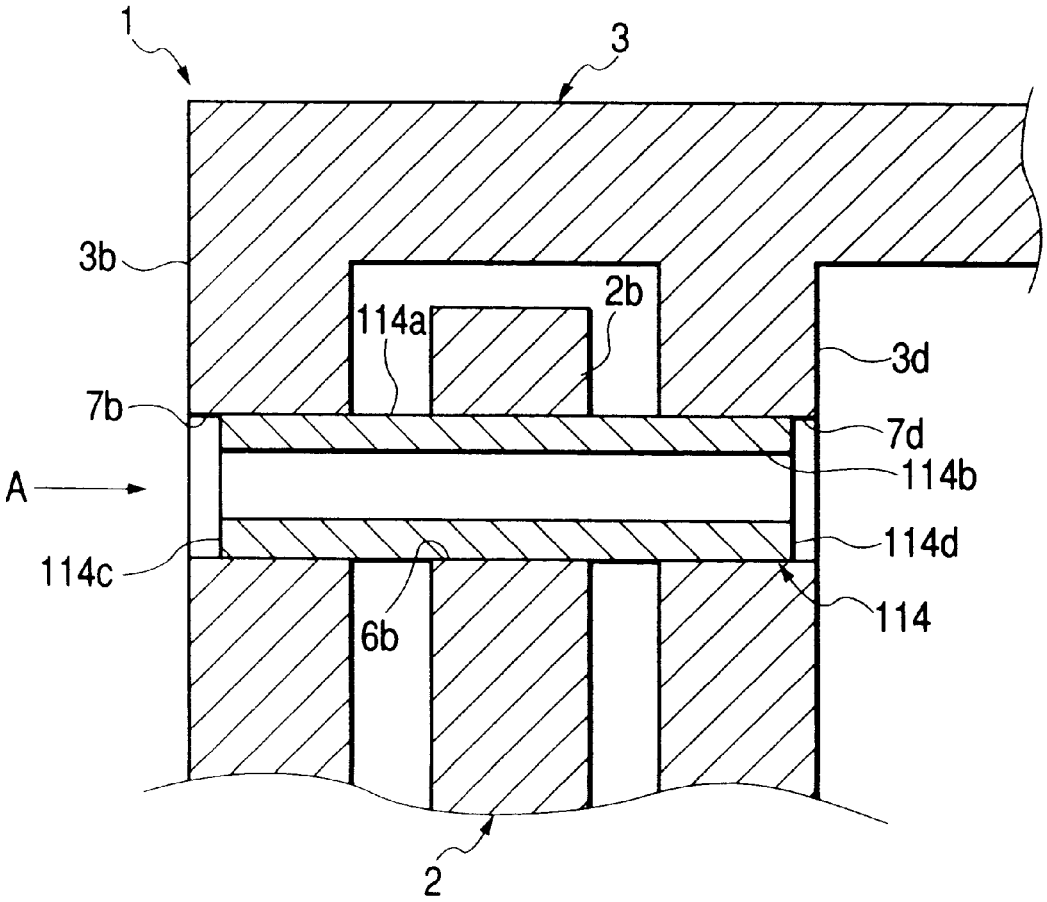
FIG. 8B is a cross-sectional view of a connecting portion of the developing container and the cleaning container using this connecting pin.
Figure 9A:
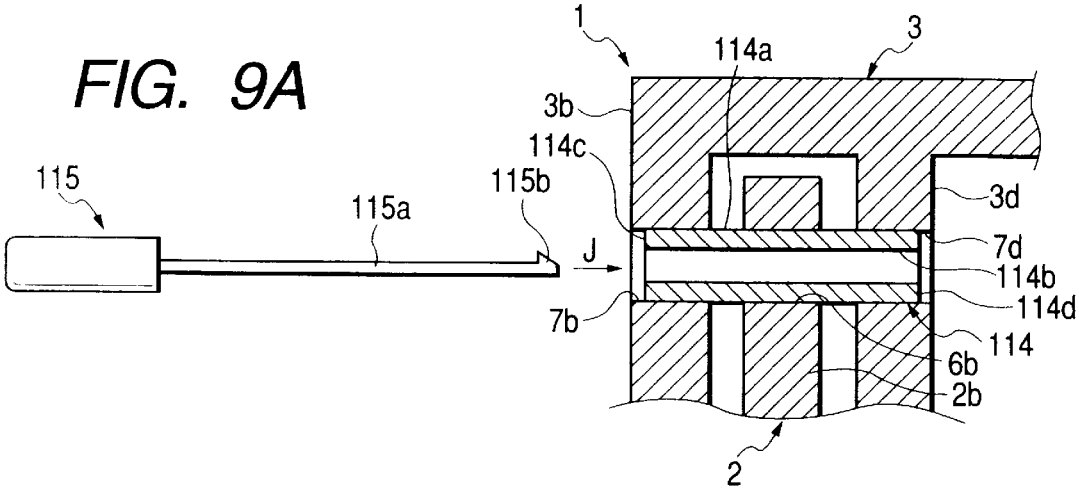
FIGS. 9A, 9B and 9C are views for explaining that the connecting pin shown in FIGS. 8A and 8B is pulled out.
Figure 9B:
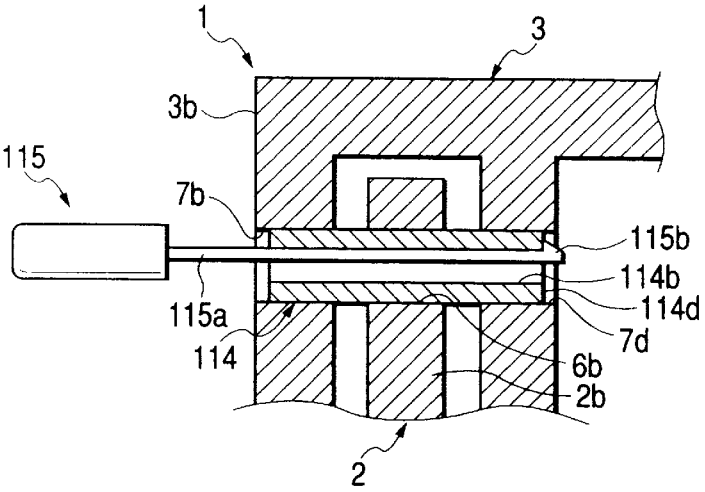
Figure 9C:
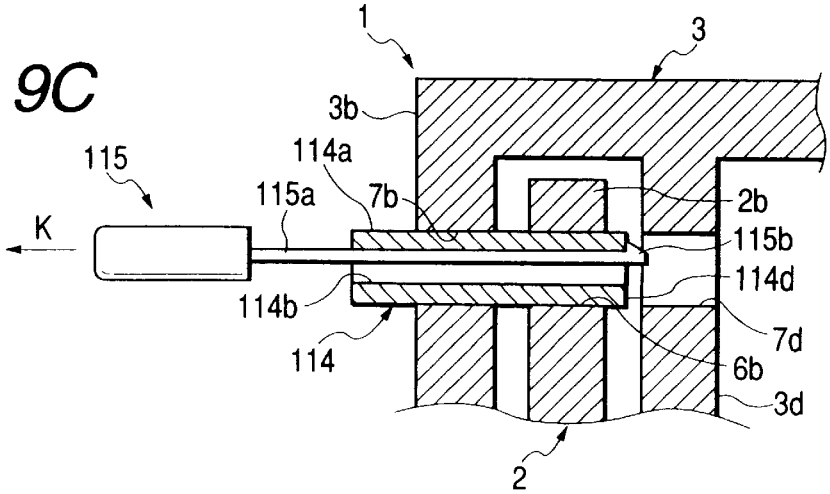

A third embodiment will next be explained with reference to FIGS. 8A, 8B, 9A, 9B and 9C. FIG. 8A is a perspective view of a connecting pin according to this embodiment. FIG. 8B is a cross-sectional view of a connecting portion of the developing container and the cleaning container connected by the connecting pin shown in FIG. 8A. FIGS. 9A, 9B and 9C are views for explaining how the connecting pin according to this embodiment is pulled out.

According to this embodiment, members common to those in the first embodiment are designated by the same reference numerals, and their explanations are omitted here. Further, connecting structures of the cleaning container and the developing container using the respective connecting pins arranged on both sides of the process cartridge in its longitudinal direction are the same. Accordingly, the connecting structure of the cleaning container and the developing container using one connecting pin will be explained in this embodiment.

A connecting pin 114 according to this embodiment has a connecting portion 114*a* fitted into connecting holes 7*b*, 7*d* formed in an outer wall 3*b* and an inner wall 3*d* of the cleaning container 3, and a connecting hole 6*b* formed in an arm portion 2*b* of the developing container 2. The connecting portion 114*a* rotatably connects the cleaning container 3 and the developing container 2 to each other. The connecting portion 114*a* has a hollow portion 114*b* on an axial line and is formed in a cylindrical shape. The hollow portion 114*b* is arranged to insert a bar shaped shaft portion 115*a* of a tool 115 therethrough (see FIGS. 9A to 9C) used when the connecting pin 114 is pulled out of the process cartridge 1. The connecting portion 114*a* is formed such that an end surface (an end surface on a side opposed to an insertion direction) 114*c* on a side of the outer wall 3*b* of the cleaning container 3 is substantially flush with the outer wall 3*b* of the cleaning container 3 so as not to project from this outer wall 3*b* in a state in which the developing container 2 and the cleaning container 3 are completely connected to each other.

In a connecting method of the developing container 2 and the cleaning container 3 using the connecting pin 114, diametrical sizes of the connecting holes 7*b*, 6*b*, 7*d* and the connecting portion 114*a* are determined such that the connecting portion 114*a* is forcibly fitted into the connecting holes 7*b*, 7*d* formed in the outer wall 3*b* and the inner wall 3*d* of the cleaning container 3, and is loosely fitted into the connecting hole 6*b* formed in the arm portion 2*b* of the developing container 2.

When the developing container 2 and the cleaning container 3 are connected to each other by the above connecting pin 114, the connecting portion 114*a* is inserted into each of the connecting holes 7*b*, 6*b*, 7*d* of the cleaning container 3 and the developing container 2 in the direction indicated by an arrow A. Accordingly, the developing container 2 and the cleaning container 3 are rotatably connected to each other. Thus, the connecting pin 114 is held by the cleaning container 3, and the developing container 2 is rotatably supported with respect to the cleaning container 3.

Thus, when the connecting portion 114*a* of the connecting pin 114 is inserted into each of the connecting holes 7*b*, 6*b*, 7*d* of the cleaning container 3 and the developing container 2, and the developing container 2 and the cleaning container 3 are completely connected to each other, no end surface 114*c* of the connecting pin 114 is projected from the outer wall 3*b* of the cleaning container 3.

As shown in FIGS. 9A, 9B and 9C, when the process cartridge 1 is disassembled by pulling the connecting pin 114 out of the cleaning container 3 of the process cartridge 1, a tool 115 approaches the connecting portion 114*a* (see FIG. 9A) from a direction indicated by the arrow J as an insertion direction of the connecting pin 114 to pull out the connecting pin 114. A bar-shaped shaft portion 115*a* of the tool 115 is inserted into a hollow portion 114*b* of the connecting portion 114*a*. An engaging portion 115*b* at a distal end of the shaft portion 115*a* is engaged with an end surface 114*d* of the connecting portion 114*a* on a side of the inner wall 3*d* of the cleaning container 2 (see FIG. 9B). Then, the connecting pin 114 is completely pulled out by pulling out the tool 115 in a direction indicated by the arrow K as a direction opposed to the insertion direction of the connecting pin 114.

Thus, according to this embodiment, the developing container 2 and the cleaning container 3 in the process cartridge 1 are rotatably connected to each other by the connecting pin 114 having the hollow portion 114*b*. Accordingly, the connecting pin 114 can be pulled out by engaging the tool 115 inserted into the hollow portion 114*b* with the end surface 114*d* on the side of the inner wall 3*d* of the cleaning container 2 and pulling the tool 115 in a direction opposed to insertion direction. Therefore, the process cartridge 1 can be easily disassembled without damaging the cleaning container 3, and the cleaning container 3 and the connecting pin 114 can be reused. Further, since no end surface 114*c* of the connecting pin 114 on a side of the outer wall 3*b* of the cleaning container 3 is projected from the outer wall 3*b* of the cleaning container 3, the image forming apparatus main body A1 and the process cartridge 1 can be made compact.

The above respective embodiments are summarized as follows.

A first frame (cleaning container 3) for supporting an electrophotographic photosensitive member (photosensitive drum 5) and a second frame (developing container 2) for supporting a developing member (developing roller 4*d*) for developing an electrostatic latent image formed on the electrophotographic photosensitive member are arranged in a process cartridge 1 detachably mountable to a main body of an electrophotographic image forming apparatus and are rotatably connected to each other by a connecting member (engaging pin 8).

The connecting member has a connecting portion 8*a* inserted into a hole 7*a* to 7*d* formed in the first frame and a hole 6*a*, 6*b* formed in the second frame to connect the first and second frames; and a head portion 8*b*, 8*c*, 8*d* arranged upstream of the connecting portion in an insertion direction in which the connecting portion is inserted into the hole formed in the first frame and the hole formed in the second frame, wherein the head portion has a size smaller than a size of the connecting portion in a direction crossing the insertion direction.

The head portion 8*b*, 8*c*, 8*d* may have a circular or polygonal section in the direction crossing the insertion direction.

The head portion 8*b*, 8*c*, 8*d* may have a circular section in the direction crossing the insertion direction and irregularities are formed on an outer circumferential surface of the head portion. Irregular portions can be gripped by a tool 110.

The head portion 8*b*, 8*c*, 8*d* may define a space between the head portion and one frame located on inner and outer sides of the first frame or second frame in the direction crossing the insertion direction in the connection of the first frame (cleaning container 3) and the second frame (developing container 2), and the tool 110 can be inserted into the space and the head portion can be gripped by the tool when the connecting member is pulled out.

A process cartridge 1 detachably mountable to a main body of an electrophotographic image forming apparatus comprises:

an electrophotographic photosensitive member (photosensitive drum 5);

a first frame (cleaning container 3) for supporting the electrophotographic photosensitive member;

a developing member (developing roller 4*d*) for developing an electrostatic latent image formed on the electrophotographic photosensitive member;

a second frame (developing container 2) for supporting the developing member; and a connecting member (connecting pin 8) for rotatably connecting the first and second frames to each other and constructed such that the connecting member has a connecting portion 8*a* inserted in holes 7*a* to 7*d* formed in the first frame and a hole 6*a*, 6*b* formed in the second frame to connect the first and second frames, and a head portion 8*b*, 8*c*, 8*d* arranged upstream of the connecting portion in an insertion direction of the connecting portion inserted in the holes formed in the first and second frames, and the head portion 8*b*, 8*c*, 8*d* has a size smaller than a size of the connecting portion in a direction crossing the insertion direction.

Here, an end surface of the head portion 8*b*, 8*c*, 8*d* is substantially flush with an external surface of one frame located outside of the first frame or the second frame, or is located on the inner side from the external surface of the frame in the direction crossing the insertion direction on connecting of the first and second frames.

An electrophotographic image forming apparatus to which a process cartridge is detachably mountable for forming an image on a recording medium, the electrophotographic image forming apparatus comprises:

(a) a mounting portion for detachably mounting the process cartridge;

the process cartridge having:

an electrophotographic photosensitive member (photosensitive drum 5);

a first frame (cleaning container 3) for supporting the electrophotographic photosensitive member;

a developing member (developing roller 4*d*) for developing an electrostatic latent image formed on the electrophotographic photosensitive member;

a second frame (developing container 2) for supporting the developing member; and a connecting member (connecting pin 8) for rotatably connecting the first and second frames to each other and constructed such that the connecting member has a connecting portion 8*a* inserted in holes 7*a* to 7*d* formed in the first frame and a hole 6*a*, 6*b* formed in the second frame to connect the first and second frames, and a head portion 8*b*, 8*c*, 8*d* arranged upstream of the connecting portion in an insertion direction of the connecting portion inserted in the holes formed in the first and second frames, and the head portion has a size smaller than a size of the connecting portion in a direction crossing the insertion direction; and (b) a conveying member for conveying the recording medium.

In the connecting member, the head portion is pulled out of the process cartridge by gripping the head portion by the tool within the space between the head portion and the hole on the external side of the first frame and pulling this head portion in a direction opposed to the insertion direction. Therefore, the process cartridge can be easily disassembled into the first and second frames without damaging the first frame, and the first frame and the connecting member can be reused. Further, since the end surface of the head portion of the connecting member is substantially flush with an external side surface of the first frame, the image forming apparatus main body and the process cartridge can be made compact.

[Other Embodiments]

A monochromatic image is formed as an example in the process cartridge shown in the aforementioned embodiments. However, the present invention can be also suitably applied to a process cartridge in which plural developing means are arranged and an image of plural colors (a two-color image, a three-color image or a full color image, etc.) is formed.

The electrophotographic photosensitive member is not limited to the photosensitive drum. For example, the electrophotographic photosensitive member includes the following members. First, a photoelectric conductor is used as the photosensitive drum. For example, amorphous silicon, amorphous selenium, zinc oxide, titanium oxide, and an organic photoconductor (OPC) are included in the photoelectric conductor. Further, for example, a drum or a belt is used as the photosensitive member. For example, in the photosensitive member of the drum type, the photoelectric conductor is evaporated or coated, on a cylinder of an aluminum alloy.

A so-called contact charging method is used in the construction of the charging means in the aforementioned embodiments. However, the charging means may also have another construction in which a metallic shield of aluminum is formed around three sides of a tungsten wire conventionally used, and positive or negative ions caused by applying a high voltage to the tungsten wire are moved onto the surface of the photosensitive drum, and the surface of the photosensitive drum is uniformly charged.

The charging means may also be of blade (charging blade), bud, block, rod, wire types in addition to the roller type.

In a cleaning method of toner left on the photosensitive drum, the cleaning means may also be constructed by using a blade, a fur brush, a magnetic brush.

For example, the above process cartridge has the electrophotographic photosensitive member and at least one process means. Accordingly, in a mode of the process cartridge, for example, the electrophotographic photosensitive member and the charging means may also be integrally made into a cartridge which is detachably mountable to the apparatus main body in addition to the above embodiments. Further, in the mode of the process cartridge, the electrophotographic photosensitive member and the developing means may also be integrally made into a cartridge which is detachably mountable to the apparatus main body. In the mode of the process cartridge, the electrophotographic photosensitive member and the cleaning means may also be integrally made into a cartridge which is detachably mountable to the apparatus main body. Further, in the mode of the process cartridge, the electrophotographic photosensitive member and two process means or more may also be combined and integrally made into a cartridge which is detachably mountable to the apparatus main body.

Namely, the process cartridge is constructed such that the electrophotographic photosensitive member and the charging means, the developing means or the cleaning means are integrally made into a cartridge and this cartridge can be detachably mountable to the image forming apparatus main body. The process cartridge may also be constructed such that the electrophotographic photosensitive member and at least one of the charging means, the developing means and the cleaning means are integrally made into a cartridge which is detachably mountable to the image forming apparatus main body. Further, the process cartridge may also be constructed such that at least the developing means and the electrophotographic photosensitive member are integrally made into a cartridge which is detachably mountable to the image forming apparatus main body. This process cartridge can be personally detachably to the apparatus main body by a user. Therefore, the apparatus main body can be personally maintained by the user.

Further, in the above embodiments, the laser beam printer is shown as an example of the electrophotographic image forming apparatus. However, the present invention is not limited to a laser beam printer. For example, it is possible to use an electrophotographic image forming apparatus such as an electrophotographic copying machine, a facsimile telegraph, or a word processor.

In the connecting member in each of the above embodiments, the process cartridge can be easily disassembled into the first and second frames without damaging the first frame, and the process cartridge and the electrophotographic image forming apparatus main body capable of detachably attaching the process cartridge thereto can be made compact.

The process cartridge in each of the above embodiments can be easily disassembled into the first and second frames, and the first frame and the connecting member can be reused:

In the electrophotographic image forming apparatus in each of the above embodiments, it is possible to detachably mount the process cartridge to be easily disassembled into the first and second frames and able to reuse the first frame and the connecting member.

As explained above, the connecting member can be easily pulled out in accordance with the present invention.

While the invention has been described with reference to the structures disclosed therein, it is not confined to the details set forth and this application is intended to cover such modifications or changes as may come within the purposes of the improvements or the scope of the following claims.

What is claimed is:

1. A connecting member for rotatably connecting a first frame and a second frame of a process cartridge detachably mountable to a main body of an electrophotographic image forming apparatus, said first frame for holding an electrophotographic photosensitive member and said second frame for holding developing means for developing an electrostatic latent image formed on said electrophotographic photosensitive member with a developer, said connecting member comprising:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other; and a head portion formed on said connecting portion on a side opposed to an insertion direction in which said connecting portion is inserted into the external hole of said first frame, the hole of said second frame, and the internal hole of said first frame, wherein said head portion has a diameter smaller than a diameter of said connecting portion, and also has an end surface substantially flush with an external side surface of said first frame on the external side surface side of said first frame in a state in which said first and second frames are rotatably connected to each other by said connecting portion, and further defines a space for gripping said head portion by a tool between the head portion and the external hole of said first frame.

2. A connecting member according to claim 1, wherein said head portion has a circular or polygonal shape in cross section.

3. A connecting member according to claim 1, wherein said head portion has a circular shape in cross section and a screw portion is formed on a circumferential surface of said head portion.

4. A connecting member for connecting a first frame and a second frame of a process cartridge detachably mountable to a main body of an electrophotographic image forming apparatus, said first frame for holding an electrophotographic photosensitive member and said second frame for holding developing means for developing an electrostatic latent image formed on said electrophotographic photosensitive member with a developer, said connecting member comprising:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other; and a screw portion formed on said connecting portion on a side opposed to an insertion direction in which said connecting portion is inserted into the external hole of said first frame, the hole of said second frame, and the internal hole of said first frame, said screw portion being engageable with a part of the internal hole of said first frame;

wherein said connecting portion has an end surface substantially flush with an external side surface of said first frame on the external side surface side of said first frame in a state in which said screw portion is engaged with the part of the internal hole of said first frame so that said first and second frames are rotatably connected to each other, and a polygonal boss or a polygonal hole engagable with a tool for rotating said connecting portion is formed on said end surface.

5. A connecting member for connecting a first frame and a second frame of a process cartridge detachably mountable to a main body of an electrophotographic image forming apparatus, said first frame for holding an electrophotographic photosensitive member and said second frame for holding developing means for developing an electrostatic latent image formed on said electrophotographic photosensitive member with a developer, said connecting member comprising:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other, wherein said connecting portion has an end surface substantially flush with an external side surface of said first frame on a side opposed to an insertion direction in which said connecting portion is inserted into the external hole of said first frame, the hole of said second frame, and the internal hole of said first frame in a state in which said first and second frames are rotatably connected, and said connecting portion has a hollow portion into which a tool for pulling out said connecting portion in a direction opposed to the insertion direction can be inserted.

6. A process cartridge detachably mountable to a main body of an electrophotographic image forming apparatus, said process cartridge comprising:

an electrophotographic photosensitive member;

developing means for developing an electrostatic latent image formed on said electrophotographic photosensitive member with a developer;

a first frame for holding said electrophotographic photosensitive member;

a second frame for holding said developing means; and a connecting member for rotatably connecting said first and second frames to each other, said connecting member having:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other; and a head portion formed on said connecting portion on a side opposed to an insertion direction in which said connecting portion is inserted into the external hole of said first frame, the hole of said second frame, and the internal hole of said first frame, wherein said head portion has a diameter smaller than a diameter of said connecting portion, and has an end surface substantially flush with an external side surface of said first frame on the external side surface side of said first frame in a state in which said first and second frames are rotatably connected to each other by said connecting portion, and defines a space for gripping said head portion by a tool between the head portion and the external hole of said first frame.

7. A process cartridge according to claim 6, wherein said head portion has a circular or polygonal shape in cross section.

8. A process cartridge according to claim 6, wherein said head portion has a circular shape in cross section and a screw portion is formed on a circumferential surface of said head portion.

9. A process cartridge detachably mountable to a main body of an electrophotographic image forming apparatus, said process cartridge comprising:

an electrophotographic photosensitive member;

developing means for developing an electrostatic latent image formed on said electrophotographic photosensitive member with a developer;

a first frame for holding said electrophotographic photosensitive member;

a second frame for holding said developing means; and a connecting member for rotatably connecting said first and second frames to each other, said connecting member having:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other; and a screw portion formed on said connecting portion on a side opposed to an insertion direction in which said connecting portion is inserted into the external hole of said first frame, hole of said second frame and the internal hole of said first frame, the screw portion being engageable with a part of the internal hole of said first frame, wherein said connecting portion has an end surface substantially flush with an external side surface of said first frame on the external side surface side of said first frame in a state in which said screw portion is engaged with the part of the internal hole of said first frame so that said first and second frames are rotatably connected to each other, and a polygonal boss or a polygonal hole engageable with a tool for rotating said connecting portion is formed on said end surface.

10. A process cartridge detachably mountable to a main body of an electrophotographic image forming apparatus, said process cartridge comprising:

an electrophotographic photosensitive member;

developing means for developing an electrostatic latent image formed on said electrophotographic photosensitive member with a developer;

a first frame for holding said electrophotographic photosensitive member;

a second frame for holding said developing means; and a connecting member for rotatably connecting said first and second frames to each other, said connecting member having:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other, wherein said connecting portion has an end surface substantially flush with an external side surface of said first frame on a side opposed to an insertion direction in which said connecting portion is inserted into the external hole of said first frame, the hole of said second frame, and the internal hole of said first frame in a state in which said first and second frames are rotatably connected, and said connecting portion has a hollow portion into which a tool for pulling out said connecting portion in a direction opposed to the insertion direction can be inserted.

11. A process cartridge detachably mountable to a main body of an electrophotographic image forming apparatus, said process cartridge comprising:

an electrophotographic photosensitive member;

developing means for developing an electrostatic latent image formed on said electrophotographic photosensitive member with a developer;

a first frame for holding said electrophotographic photosensitive member;

a second frame for holding said developing means; and a connecting member for rotatably connecting said first and second frames to each other, said connecting member having:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other;

wherein said connecting portion has an end surface substantially flush with an external side surface of said first frame on a side opposed to an insertion direction in which said connecting portion is inserted into the external hole of said first frame, the hole of said second frame, and the internal hole of said first frame in a state in which said first and second frames are rotatably connected, and a stepped hole for defining a space for gripping an end portion of said connecting portion on its end surface side by a tool is formed in the external hole of said first frame on the external side surface side.

12. A process cartridge according to claim 6, 9, 10 or 11, wherein said electrophotographic photosensitive member, said developing means and at least one of charging means for charging said electrophotographic photosensitive member and cleaning means for removing the developer left on said electrophotographic photosensitive member are integrally made into a cartridge as said process cartridge which is detachable mountable to said main body of said electrophotographic image forming apparatus.

13. An electrophotographic image forming apparatus to which a process cartridge is detachably mountable for forming an image on a recording medium, said electrophotographic image forming apparatus comprising:

(a) mounting means for detachably mounting the process cartridge, the process cartridge having:

an electrophotographic photosensitive member;

developing means for developing an electrostatic latent image formed on said electrophotographic photosensitive member with a developer;

a first frame for holding said electrophotographic photosensitive member;

a second frame for holding said developing means; and a connecting member for rotatably connecting said first and second frames to each other, said connecting member having:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other; and a head portion formed in said connecting portion on a side opposed to an insertion direction in which said connecting portion is inserted into the external hole of said first frame, the hole of said second frame, and the internal hole of said first frame, wherein said head portion has a diameter smaller than a diameter of said connecting portion, and has an end surface substantially flush with an external side surface of said first frame on the external side surface side of said first frame in a state in which said first and second frames are rotatably connected to each other by said connecting portion, and defines a space for gripping said head portion by a tool between the head portion and the external hole of said first frame; and (b) conveying means for conveying said recording medium.

14. An electrophotographic image forming apparatus to which a process cartridge is detachably mountable for forming an image on a recording medium, said electrophotographic image forming apparatus comprising:

(a) mounting means for detachably mounting the process cartridge, the process cartridge having:

an electrophotographic photosensitive member;

developing means for developing an electrostatic latent image formed on said electrophotographic photosensitive member with a developer;

a first frame for holding said electrophotographic photosensitive member;

a second frame for holding said developing means; and a connecting member for rotatably connecting said first and second frames to each other, said connecting member having:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other; and a screw portion formed on said connecting portion on a side opposed to an insertion direction in which said connecting portion is inserted into the external hole of said first frame, the hole of said second frame, and the internal hole of said first frame, said screw portion being engageable with a part of said internal hole of said first frame, wherein said connecting portion has an end surface substantially flush with an external side surface of said first frame on the external side surface side of said first frame in a state in which said screw portion is engaged with said part of said internal hole of said first frame so that said first and second frames are rotatably connected to each other, and a polygonal boss or a polygonal hole engageable with a tool for rotating said connecting portion is formed on said end surface; and (b) conveying means for conveying said recording medium.

15. An electrophotographic image forming apparatus to which a process cartridge is detachably mountable for forming an image on a recording medium, said electrophotographic image forming apparatus comprising:

(a) mounting means for detachably mounting the process cartridge, the process cartridge having:

an electrophotographic photosensitive member;

developing means for developing an electrostatic latent image formed on said electrophotographic photosensitive member with a developer;

a first frame for holding said electrophotographic photosensitive member;

a second frame for holding said developing means;

a connecting member for rotatably connecting said first and second frames to each other, said connecting member having:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other, wherein said connecting portion has an end surface substantially flush with an external side surface of said first frame on a side opposed to an insertion direction in which said connecting portion is inserted into the external hole of said first frame, the hole of said second frame, and the internal hole of said first frame in a state in which said first and second frames are rotatably connected, and said connecting portion has a hollow portion into which a tool for pulling out said connecting portion in a direction opposed to the insertion direction can be inserted; and (b) conveying means for conveying said recording medium.

16. An electrophotographic image forming apparatus to which a process cartridge is detachably mountable for forming an image on a recording medium, said electrophotographic image forming apparatus comprising:

(a) mounting means for detachably mounting the process cartridge, the process cartridge having:

an electrophotographic photosensitive member;

developing means for developing an electrostatic latent image formed on said electrophotographic photosensitive member with a developer;

a first frame for holding said electrophotographic photosensitive member;

a second frame for holding said developing means; and a connecting member for rotatably connecting said first and second frames to each other, said connecting member having:

a connecting portion which is fitted into an external hole formed in an external side of said first frame, an internal hole formed in an internal side of said first frame, and a hole formed in said second frame and located between the external hole and the internal hole of said first frame, and rotatably connects said first and second frames to each other, wherein said connecting portion has an end surface substantially flush with an external side surface of said first frame on a side opposed to an insertion direction in which said connecting portion is inserted into the external hole of said first frame, the hole of said second frame, and the internal hole of said first frame in a state in which said first and second frames are rotatably connected; and a stepped hole for defining a space for gripping an end portion of said connecting portion on its end surface side by a tool is formed on the external side surface side in the external hole of said first frame; and (b) conveying means for conveying said recording medium.

17. A connecting member for rotatably connecting a first frame and a second frame of a process cartridge detachably mountable to a main body of an electrophotographic image forming apparatus, said first frame for supporting an electrophotographic photosensitive member and said second frame for supporting a developing member for developing an electrostatic latent image formed on said electrophotographic photosensitive member, said connecting member comprising:

a connecting portion to be inserted into a hole formed in said first frame and a hole formed in said second frame to connect said first and second frames; and a head portion arranged upstream of said connecting portion in an insertion direction in which said connecting portion is inserted into the hole formed in said first frame and the hole formed in said second frame, wherein said head portion has a size smaller than a size of said connecting portion in a direction crossing said insertion direction.

18. A connecting member according to claim 17, wherein said head portion has a circular or polygonal cross section in the direction crossing said insertion direction.

19. A connecting member according to claim 17, wherein said head portion has a circular cross section in the direction crossing said insertion direction and irregularities are formed on an outer circumferential surface of said head portion.

20. A connecting member according to claim 17, 18 or 19, wherein said head portion defines a space between said head portion and one frame, located on an outer side, of said first frame and said second frame in the direction crossing said insertion direction on connecting said first and second frames to each other, and a tool is inserted into said space and said head portion can be gripped by said tool when said connecting member is pulled out.

21. A process cartridge detachably mountable to a main body of an electrophotographic image forming apparatus, said process cartridge comprising:

an electrophotographic photosensitive member;

a first frame for supporting said electrophotographic photosensitive member;

a developing member for developing an electrostatic latent image formed on said electrophotographic photosensitive member;

a second frame for supporting said developing member; and a connecting member for rotatably connecting said first and second frames to each other, wherein said connecting member has a connecting portion inserted into a hole formed in said first frame and a hole formed in said second frame to connect said first and second frames, and a head portion arranged upstream of said connecting portion in an insertion direction of said connecting portion inserted in the holes formed in said first and second frames, and wherein said head portion has a size smaller than a size of said connecting portion in a direction crossing said insertion direction.

22. A process cartridge according to claim 21, wherein said head portion has a circular or polygonal cross section in the direction crossing said insertion direction.

23. A process cartridge according to claim 21, wherein said head portion has a circular cross section in the direction crossing said insertion direction and irregularities are formed on an outer circumferential surface of said head portion.

24. A process cartridge according to claim 21, 22 or 23, wherein said head portion defines a space between said head portion and one frame, located on an outer side, of said first frame and said second frame in the direction crossing said insertion direction on connecting said first and second frames to each other, and a tool is inserted into said space and said head portion can be gripped by said tool when said connecting member is pulled out.

25. A process cartridge according to claim 24, wherein an end surface of said head portion is substantially flush with an external surface of said one frame, located on the outer side, of said first frame and said second frame, or is located in an inside side from the external surface of said one frame in the direction crossing said insertion direction on connecting said first and second frames to each other.

26. An electrophotographic image forming apparatus to which a process cartridge is detachably mountable for forming an image on a recording medium, said electrophotographic image forming apparatus comprising:

(a) a mounting portion for detachably mounting the process cartridge, the process cartridge having:

an electrophotographic photosensitive member;

a first frame for supporting said electrophotographic photosensitive member;

a developing member for developing an electrostatic latent image formed on said electrophotographic photosensitive member;

a second frame for supporting said developing member; and a connecting member for rotatably connecting said first and second frames to each other, wherein said connecting member has a connecting portion inserted in a hole formed in said first frame and a hole formed in said second frame to connect said first and second frames, and a head portion arranged upstream of said connecting portion in an insertion direction of said connecting portion inserted in the holes formed in said first and second frames, and wherein said head portion has a size smaller than a size of said connecting portion in a direction crossing said insertion direction; and (b) a conveying member for conveying said recording medium.

* * * * *

UNITED STATES PATENT AND TRADEMARK OFFICE

CERTIFICATE OF CORRECTION

PATENT NO. : 6,327,448 B1
DATED : December 4, 2001
INVENTOR(S) : Teruhiko Sasaki It is certified that error appears in the above-identified patent and that said Letters Patent is hereby corrected as shown below:

Column 4,
Line 11, “a, cross-sectional” should read -- a cross-sectional --.

Column 16,
Line 25, “detachably” should read -- detachably mounted --.
Line 45, “reused:” should read -- reused. --.

Column 20,
Line 40, “detachable” should read -- detachably --.

Signed and Sealed this

Fourth Day of February, 2003

JAMES E. ROGAN
*Director of the United States Patent and Trademark Office*